US006419349B1

(12) United States Patent
Iwanaga et al.

(10) Patent No.: US 6,419,349 B1
(45) Date of Patent: Jul. 16, 2002

(54) LIQUID STORAGE CONTAINER, LIQUID EJECTING DEVICE AND LIQUID EJECTING APPARATUS

(75) Inventors: Shuzo Iwanaga; Kenta Udagawa, both of Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/633,885

(22) Filed: Aug. 7, 2000

(30) Foreign Application Priority Data

Aug. 24, 1999 (JP) ..... 11-236502

(51) Int. Cl.[7] ..... B41J 2/175

(52) U.S. Cl. ..... 347/86

(58) Field of Search ..... 347/85, 86, 87; 222/187, 481.5

(56) References Cited

U.S. PATENT DOCUMENTS 5,509,140 A * 4/1996 Koitabashi et al. ..... 347/86

FOREIGN PATENT DOCUMENTS

EP 624 475 * 11/1994

* cited by examiner

*Primary Examiner*—Michael Nghiem
(74) *Attorney, Agent, or Firm*—Fitzpatrick, Cella, Harper & Scinto

(57) ABSTRACT

A liquid storage tank having a compartment for accommodating a negative pressure generating member consisting of a fiber material, having a liquid supplying portion and a connecting portion with the atmosphere; a liquid storing compartment for storing liquid to be supplied to the negative pressure generating member, and having a connecting portion with the compartment for accommodating the negative pressure generating member and forming an almost closed space and a separating wall separating the compartment for accommodating the negative pressure generating member from the compartment for storing liquid and forming the connecting portion and an air importing portion for importing air from the compartment for accommodating the negative pressure generating member to the compartment for accommodating the liquid, formed in the vicinity of the connecting portion. The liquid storage tank has structure to suppress an unnecessary collapse in the negative pressure generating member in the vicinity of the air importing portion, such as concave portions on a wall opposite the separating wall in the compartment for accommodating the negative pressure generating member.

6 Claims, 16 Drawing Sheets

LIQUID STORAGE CONTAINER, LIQUID EJECTING DEVICE AND LIQUID EJECTING APPARATUS

BACKGROUND OF THE INVENTION

1. Field of the Invention

The present invention relates to a liquid storage container, a liquid ejecting device and a liquid ejecting apparatus with improved liquid supply property.

The present invention can be applied to a facsimile equipped with a copying unit and a communication unit, a word processor equipped with a printing unit etc. and moreover a printing apparatus for an industrial use combined with various processing units as well as an ordinary printing apparatus.

2. Brief Description of the Related Arts

Generally speaking an ink tank (a tank built in a recording head and an exchangeable tank is included) equipped into a printing apparatus in an ink-jet recording method, has a constitution capable of adjusting holding property of ink (Here a liquid used for enhancing a recording quality and so on is included in ink.) stored in the ink tank so as to supply the ink in a good condition to a recording head to eject ink. Since the holding property renders a pressure at ejection ports of the recording head negative against the atmosphere, it is called a negative pressure. (Hereinafter a member that generates such negative pressure is also referred as a "negative pressure generating member".)

As one of the easiest ways to generate the negative pressure, a method to utilize a capillary effect of the negative pressure generating member formed out of polyurethane foam equipped in the ink tank is often employed.

The applicant proposed in a laid-open Japanese patent No. 8-20115 an ink tank which employs fibers out of a polyolefine thermoplastic resin having various excellent properties against ink as the negative pressure generating member (A negative pressure generating member employed such fibers is also referred as "a fiber absorber".)

This ink tank bears not only excellent storage stability but also an excellent recycling property, since the tank body and the negative pressure generating member are formed out of the same kind of material.

The applicant also proposed in laid-open Japanese patents No. 7-125232 and No. 6-40043 etc., an ink tank comprised of a compartment accommodating the negative pressure generating member and a compartment accommodating ink together so as to improve volume efficiency of ink in the ink tank (Hereinafter the tank comprised in this way is referred as "an ink tank with double compartments".).

FIG. 15 shows a sectional schematic constitutional view of the above-mentioned ink tank with double compartments. The inner part of an ink tank 1 constituted in the above-mentioned way is divided by a separating wall 2 having a connecting opening 10 into two compartments one of which is virtually closed except the connecting opening 10 of the separating wall 2 and is used as a liquid accommodating compartment 3 for holding ink directly, and the other compartment is used as a negative pressure generating member accommodating compartment 4 for accommodating a negative pressure generating member 5. On walls comprising the negative pressure generating member accommodating compartment 4, an opening 6 is formed on a top wall 4*a* for importing air and an opening 8 for ink supply bearing a ink exporting member 7 is formed on a bottom wall 4*b* for supplying ink to a unshown recording head. In FIG. 15 a portion of the negative pressure generating member 5 which holds ink is shown as an area below a wave formed line. And accommodated ink in the liquid accommodating compartment is depicted with broken lines.

In the above-mentioned structure when ink is consumed at the unshown recording head, the air is imported into the negative pressure generating member accommodating compartment 4 via the opening 6 and enters into the liquid accommodating compartment 3 via the connecting opening 10 on the separating wall 2. In return, ink flows from the ink accommodating compartment 3 via the connecting opening 10 into the negative pressure generating accommodating compartment 4 and filled in the negative pressure generating member 5. (Hereinafter this movement is referred as "a gas/liquid exchange movement.") Consequently, even if ink is consumed at the recording head it is filled in the negative pressure generating member 5 in response to a consumed amount of ink so as to hold a constant amount of ink in the negative pressure generating member 5 and so as to keep the negative pressure against the recording head constant, thus a stable ink supply is attained.

As shown in FIG. 15 spaces where the negative pressure generating member is not filled, are formed by ribs 9 around the opening 6 connected with the atmosphere, namely buffer compartments 11 and an air importing portion 12 to enhance importing air, is formed around the connecting opening 10 between the negative pressure generating member compartment 4 and the liquid accommodating compartment 3.

In the above-mentioned ink tank with double compartments, contacting portions of the negative pressure generating member 5 with the separating wall 2, particularly a portion of the negative pressure generating member 5 contacting with the air importing portion 12 have a important role for determining an ink supplying property.

Namely, when a contact between the negative pressure generating member 5 and the separating wall 2 is so intimate that the negative pressure generating member 5 in the vicinity of the air importing portion 12 becomes denser, namely, the capillary effect of the portion is raised higher than surrounding portions. As a result, even ink held in the negative pressure generating member 5 is consumed, ink held around the air importing portion 12 is not consumed so that finally the air is not imported into the liquid accommodating compartment 3 and in some cases the ink supplying movement is finished as the ink remains in the liquid accommodating compartment 3.

Usually the negative pressure generating member 5 employed in the ink tank with double compartment has to be inserted into the negative pressure generating member accommodating compartment 4 after compressing the member. Namely, the forced insertion after the compression is necessary to avoid forming unnecessary air gaps that may cause ink drips, when gaps are formed between inner walls of the ink tank and the negative pressure generating member 5 and when the gaps are directly connected with the air. Since there is a probability that a displacement of the negative pressure generating member 5 may occur due to an unexpected fall of the ink tank, it is necessary to fix the negative pressure generating member 5 by the aide of elastic force derived from insertion of the compressed negative pressure generating member 5 with a larger size by a certain margin. However, in this case, as mentioned above, since a density of the portion of the negative pressure generating member 5 around the separating wall 2 becomes higher, in some cases the ink supply may be interrupted.

As measures against the above-mentioned ink interruption, a structure where a density in the portion of the negative pressure generating member 5 corresponding to the air importing portion 12 is reduced by forming the air importing portion 12 inner than the face of the separating wall 2, namely, by forming a negative pressure relaxing portion 13 is proposed. By introducing such structure having the negative pressure relaxing portion a stable gas/liquid exchange is attained due to the enhanced air import.

When the polyurethane foam is employed as the negative pressure generating member 5, a negative pressure relaxing effect is attained by forming the above-mentioned relaxing structure since the polyurethane foam can be pushed into such relaxing structure.

However, the applicant and others have found that in some cases the negative pressure relaxing structure does not function well when a fibrous absorber is employed as the negative pressure generating member in the above-mentioned ink tank with double compartments. Namely, as shown in FIGS. 16A and 16B a portion of the fibrous absorber i.e. the negative pressure generating member contacting with a portion of the separating wall 2 around the air importing portion 12, is collapsed so that enough relaxing effect is not attained due to the raised capillary effect in this portion, and thus the ink supplying procedure is finished before the gas/liquid exchange starts. Even if the gas/liquid exchange is initiated in this status, there may be a probability that the ink supply becomes incapable or the ink ejecting property in the inkjet recording head is badly affected, due to an increased pressure drop between the connecting opening 10 and the opening 8 for ink supply caused by a lowered ink/air interface which is further lowered during the ink supplying procedure.

Through studying the above-mentioned phenomena, the applicant have found the following facts.

① Since the fibrous absorber is not so elastic as the polyurethane foam due to its materiel property, it is more difficult to receive compression as a whole (particularly the orientation of the absorber affects the compression, in some cases it is more difficult to deform the absorber in an oriented direction) and local collapse (buckling) is apt to occur when a compressed rate (a dimension in a crossing direction to the separating wall of the fiber type absorber before insertion/a corresponding inner dimension of the tank case) of the fibrous absorber exceeds a certain value. 2 When the crossing direction to the separating wall of the compartment for accommodating the negative pressure generating member is selected as a direction for analysis, the negative pressure generating member receives the same repulsive forces P and p from both sides (from the separating wall 2 and from the opposite wall to the separating wall 2) respectively. However, since "the opposite wall to the separating wall 2 and a contacting surface area 18 (a hatched area in FIG. 17A) of the negative pressure generating member 5 with the opposite wall" is larger than "the separating wall around the air importing portion 12 and a contacting area (a hatched area in FIG. 17B) of the negative pressure generating member 5 with the air importing portion", a larger pressure is exerted on the side of the separating wall 2 of the negative pressure generating member 5 in terms of a repulsive force per unit area (see FIG. 17C: where a relation P<p is depicted as lengths of respective arrows.).

As a result, whenever a locally collapsed area 5*b* is generated, the locally collapsed area 5*b* is always is generated in the vicinity of the air importing area 12, which causes the above-mentioned poor ink supply (Although, a negative pressure relaxing structure 13 is formed, enough relaxing effects are not attained due to a high capillary effect caused by the collapsed area 5*b* around an area 5*a* etc. of the negative pressure generating member 5 in the vicinity of the separating wall 2.)

When the above-mentioned compressed rate is kept in a certain range (Namely, when a dimension dispersion of the negative pressure generating member 5 as the absorber is kept at a lower level.), enough amount of ink supply can be attained by the function of the negative pressure relaxing structure, due to that the collapsed area 5*b* in the negative pressure generating member 5 is kept small in its size. (In the ink tank with double compartments where presently the fibrous absorber etc. is employed, this is not a too significant problem.)

However, sometimes depend on a fiber type and so on employed in the fibrous absorber for the negative pressure generating member, cut fibers are not precise enough in their sizes In this case, a ink supply is deteriorated by the above-mentioned collapse due to a larger sized fibrous absorber caused by a large dispersion in fiber size of the absorber, which leads to a low production yield.

When an ink-jet printer with higher printing rate and also with more increased ink supply is required, the collapsed areas should be suppressed so as to provide a liquid storage tank with more improved quality.

SUMMARY OF THE INVENTION

The objective of the present invention is to provide a liquid storage tank which can realize more stable ink supply, a liquid ejecting device equipped with the liquid storage tank and a liquid ejecting apparatus equipped with the liquid ejecting device by suppressing collapsed areas of the fibrous absorber around the air importing portion in the ink tank with double compartments where the negative pressure generating member such as the fibrous absorber etc. are employed.

In order to attain the above-mentioned objective, a liquid storage tank is consisted of; a negative pressure generating member accommodating compartment accommodating a negative pressure generating member consisting of a fiber material, having a liquid supplying portion and a connecting portion with the atmosphere; a liquid accommodating compartment for storing liquid to be supplied to the negative pressure generating member, having a connecting portion with the negative pressure generating member accommodating compartment and forming an almost closed space; a separating wall separating the negative pressure generating member accommodating compartment from the liquid accommodating compartment and having the connecting portion connecting both compartments; and an air importing portion forming a path for importing air from the negative pressure generating member accommodating compartment to the liquid accommodating compartment in the vicinity of the connecting portion; wherein the liquid storage tank has a means to suppress unnecessary collapsed areas in the negative pressure generating member in the vicinity of the air importing portion.

The liquid storage tank according to the present invention is also characterized by that the tank has a constitution to relax a contact status against a wall facing opposite to the separating wall in the vicinity of the air importing portion as the means to suppress the collapse.

The liquid storage tank according to the present invention is further characterized by that concave portions are formed on the wall facing opposite to the separating wall as the means to relax the above-mentioned contact status. The liquid storage tank according to the present invention is characterized by that a portion of the above-mentioned negative pressure generating member is deformed in a direction so as to be apart from the inner wall as the means to relax the above-mentioned contact status.

The liquid storage tank according to the present invention is also characterized by that the contact area of the concave portions with the negative pressure generating member is smaller than the contacting area in the vicinity of the air importing portion with the negative pressure generating member.

The liquid storage tank according to the present invention is characterized by that the concave portions are comprised by a plurality of grooves in a vertical direction with an opening for air discharge on its upper part.

The liquid storage tank according to the present invention is also characterized by that the concave portions are comprised by a plurality of grooves in a horizontal direction and the neighboring grooves are connected each other via notches.

The liquid storage tank according to the present invention is further characterized by that the negative pressure generating member formed out of the fiber material is comprised by laminated fiber members oriented almost in the same direction so as to cross the separating wall.

And further the liquid storage tank according to the present invention is characterized by that the fiber members are polyolefine resin fibers.

A liquid ejecting device consisted of a liquid storage tank having; a negative pressure generating member accommodating compartment for accommodating a negative pressure generating member consisting of a fiber material, having a liquid supplying portion and a connecting portion with the atmosphere; a liquid accommodating compartment for storing liquid to be supplied to the negative pressure generating member, having a connecting portion with the negative pressure generating member accommodating compartment and forming an almost closed space; a separating wall separating the negative pressure generating member accommodating A compartment from the liquid accommodating compartment and forming the connecting portion connecting both compartments and an air importing portion for importing air from the negative pressure generating member accommodating compartment to the liquid accommodating compartment formed in the vicinity of the connecting portion; and of a recording means by ejected liquid supplied from the liquid storage tank: wherein the liquid storage tank has a means to suppress unnecessary collapsed areas in the negative pressure generating member in the vicinity of the air importing portion.

A liquid ejecting apparatus consisted of a liquid ejecting device having; a negative pressure generating member accommodating compartment for accommodating a negative pressure generating member consisting of a fiber material, having a liquid supplying portion and a connecting portion with the atmosphere; a liquid accommodating compartment for storing liquid to be supplied to the negative pressure generating member, having a connecting portion with the negative pressure generating member accommodating compartment and forming an almost closed space; a separating wall separating the negative pressure generating member accommodating compartment from the liquid accommodating compartment having the connecting portion; an air importing portion for importing air from the negative pressure generating member accommodating compartment to the liquid accommodating compartment formed in the vicinity of the connecting portion; and a recording means by means of ejected liquid supplied from the liquid storage tank; and of a carriage device for scanning on which the liquid ejecting device is mounted: wherein the liquid storage tank has a means to suppress unnecessary collapsed areas in the negative pressure generating member in the vicinity of the air importing portion.

The liquid storage tank, the liquid ejecting device and liquid ejecting apparatus according to the present invention constituted in the above-mentioned ways, can attain a stable ink supply, in other words, a good printing quality, since the collapse, namely, the capillary effects caused by the collapse is suppressed, thus a smooth gas/liquid exchange is attained.

BRIEF DESCRIPTION OF DRAWINGS

FIG. 6A illustrates a mounted status and FIG. 6B illustrates a dismounted status.

FIG. 11A is a longitudinal sectional view and FIG. 11B is a perspective view of a wall.

FIG. 14A shows a relaxation structure against a collapse with a deformed fibrous absorber formed by one part and FIG. 14B shows another relaxation structure against a collapse with a deformed fibrous absorber formed by two parts.

FIG. 16A and FIG. 16B are longitudinal sectional views.

FIG. 17A and FIG. 17B are perspective views and FIG. 17C is a cross-sectional view along the A—A line in FIG. 16A.

DETAILED DESCRIPTION OF THE PREFERRED EMBODIMENTS

Hereinafter preferred embodiments according to the present invention are described, where a word "print"

(sometimes referred as "record") does not always mean forming meaningful information such as characters and graphics etc., but also widely means forming images, graphic designs and patterns etc. on various printing media whether they are meaningful or not, or whether they are obviously recognized visually by human eyes or not, and also means processing such media.

Here words "printing media" do not always mean papers usually employed in printing units, but also widely mean objects which can accept ink such as cloths, plastic films, metal plates, glass, ceramics, wood and leather etc.

Further, a word "ink" (sometimes referred as "liquid") should be widely interpreted as the case of the above-mentioned "print", namely it means liquid which is employed in forming images, graphic designs and patterns etc. or in processing printing media in treating ink (making pigment in ink applied on the printing media, solidify or be insoluble).

Hereinafter, detailed preferred embodiments relating to printing apparatuses according to the present invention are explained by referring to drawings.

Hereinafter a printing apparatus where an ink-jet recording method is employed, is explained, as an example.

Printing Apparatus

Figure 1:
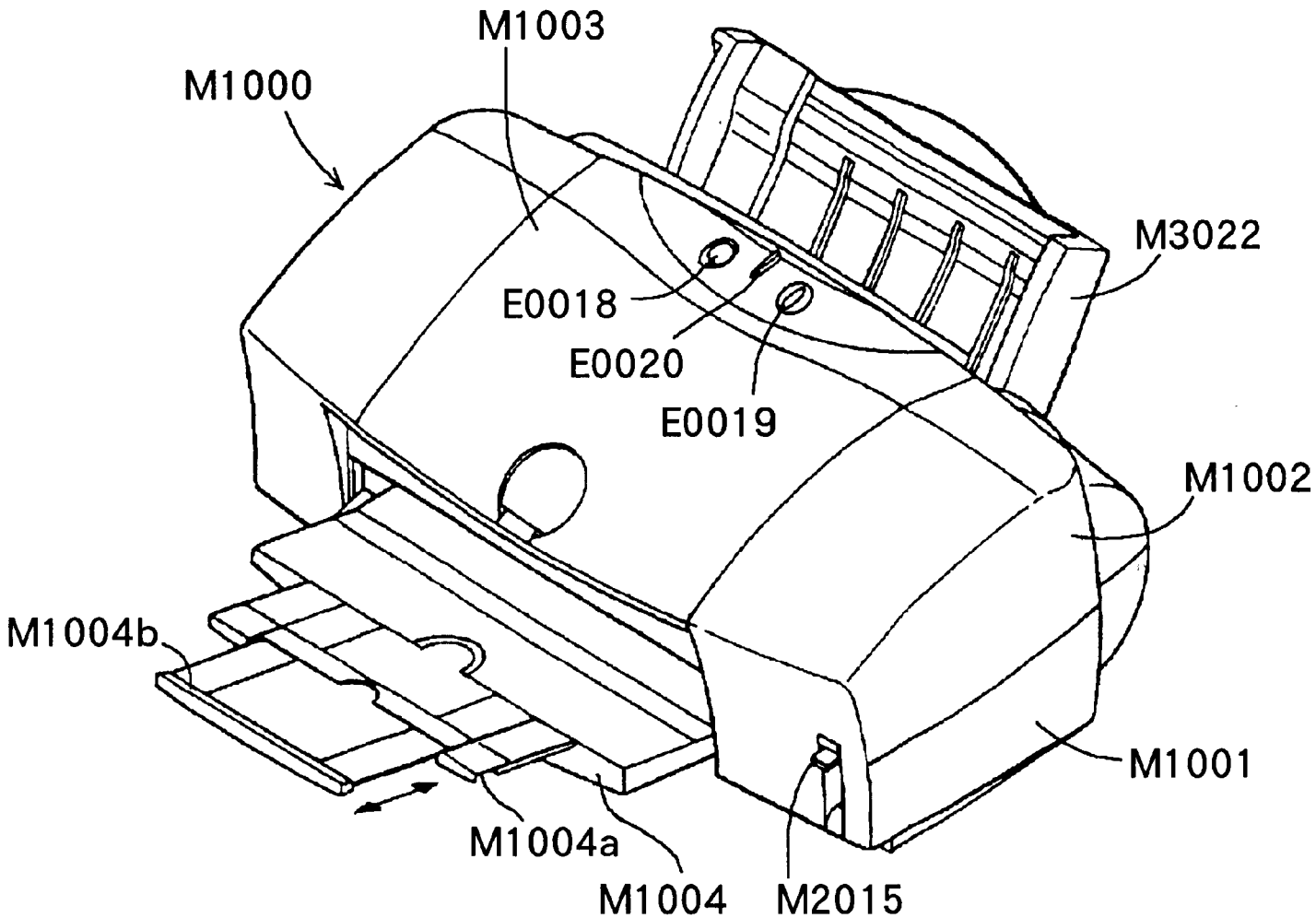
FIG. 1 is a perspective view illustrating an exterior of an ink-jet printer in an embodiment of the present invention.
Figure 2:
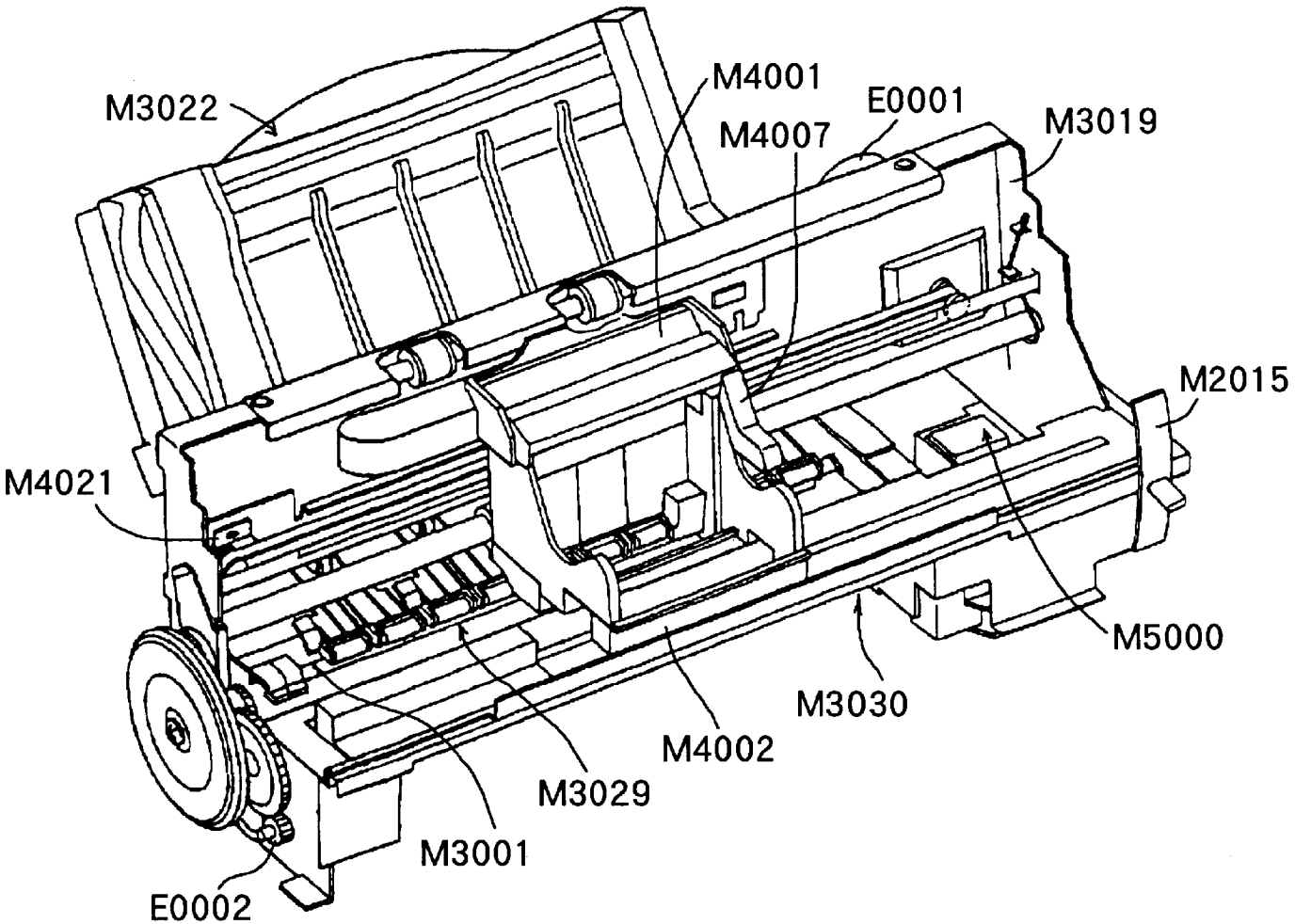
FIG. 2 is a perspective view of the printer in FIG. 1 in a state where exterior covers are removed.

An outline structure of a printer employing the ink-jet recording method are shown in FIG. 1 and FIG. 2. In FIG. 1 a main body M1000 forming an outer shell of the printer in the embodiment, is comprised of casing members i.e. a lower case M1001, an upper case M1002, an access cover M1003 and an ejection tray M1004, and of a chassis M3019 (see FIG. 2) accommodated in the casing members.

The above-mentioned chassis M3019 is consisted of a plurality of metal plate members having a required rigidity so as to form a framework that holds respective recording performing devices which will be described later.

The above-mentioned lower case M1001 forms nearly a lower half portion of the main body M1000 and the upper case M1002 forms nearly an upper half portion of the main body M1000, where both cases form a hollow structure having a space accommodating various devices which will be explained later, and openings are formed at an upper surface and a front surface of those cases respectively.

One end of the above-mentioned ejection tray M1004 is rotatably held by the lower case M1001 so as to open/shut the above-mentioned opening at the front surface of the lower case M1001. Which enable the printer to eject recorded sheets and to pile up the ejected sheets by rotating the ejection tray M1004 to the front side of the tray so as to form the portion. In the ejection tray M1004 sub trays M1004*a* and M1004*b* are accommodated to adjust a paper supporting area stepwise, namely a larger, ordinal or smaller area.

The access cover M1003, one of which end is rotatably held by the upper case M1002 so as to open/shut the opening formed on the upper surface, where a recording head cartridge H1000 or a liquid accommodating container H1900 (see FIG. 3) etc. can be exchanged by opening the access cover M1003. When the access cover M1003 is opened or shut, it rotates a open/shut lever with a protruding portion (not shown) formed on the rear side of the cover and so as to detect a status i.e. open or shut, of the access cover by detecting a rotated position of the lever with a micro switch etc.

On a rear portion of the upper surface of the upper case M1002, a power key E0018 and a resume key E0019 are arranged so as to be pushed down, and an LED E0020 is also arranged so as to inform "can start recording" by lighting the LED E0020 when the power key is pushed. The LED E0020 have various indicating functions such as informing operators of troubles in the printer by varying on/off modes and colors of the LED E0020 and by sounding a buzzer E0021 (see FIG. 7). When the troubles are settled the recording can be resumed by pushing the resume key E0019.

Record Performing Devices

Hereinafter record performing devices accommodated and held in the main body M1000 of the above-mentioned printer are descreibed.

The record performing devices in the present embodiment is comprised of an automatic feeder M3022 which automatically feeds recording sheets to the main body of the printer, a conveying member M3029 which guides each sheet sent from the automatic feeder to a desired printing position and from there to an ejection member M3030, a recording member which records desired recording on the sheet sent to the conveying member M3029 and a recuperating member (M5000) which performs recuperation treatments against the above-mentioned recording member etc.

(Recording Member)

Hereinafter the recording member is explained.

The recording member is constituted of a carriage M4001 movably supported by a carriage axis M4021 and a recording head cartridge H1000 (see FIG. 3) detachably mounted on the carriage M4001.

(Recording Head Cartridge)

Figure 3:
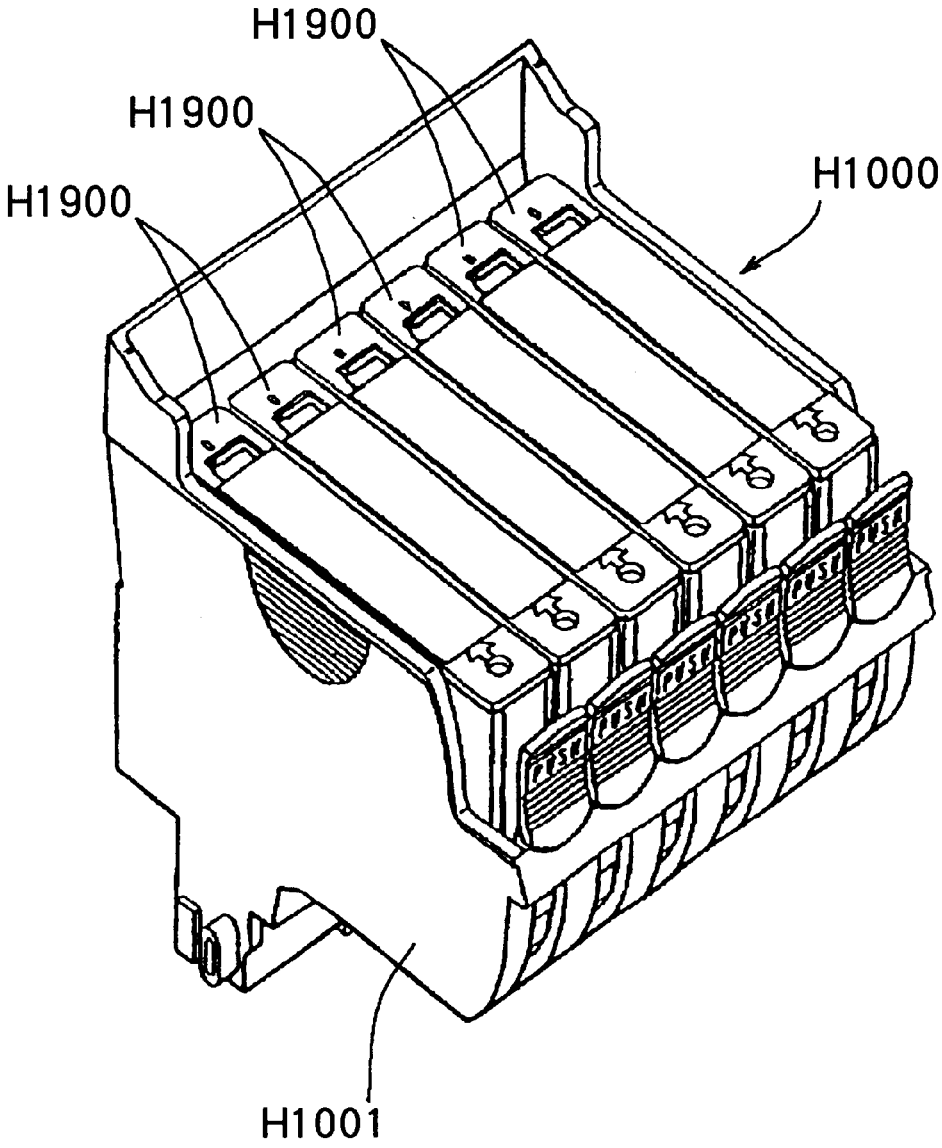
FIG. 3 is a perspective view illustrating an assembled status of a recording head cartridge in an embodiment of the present invention.
Figure 4:
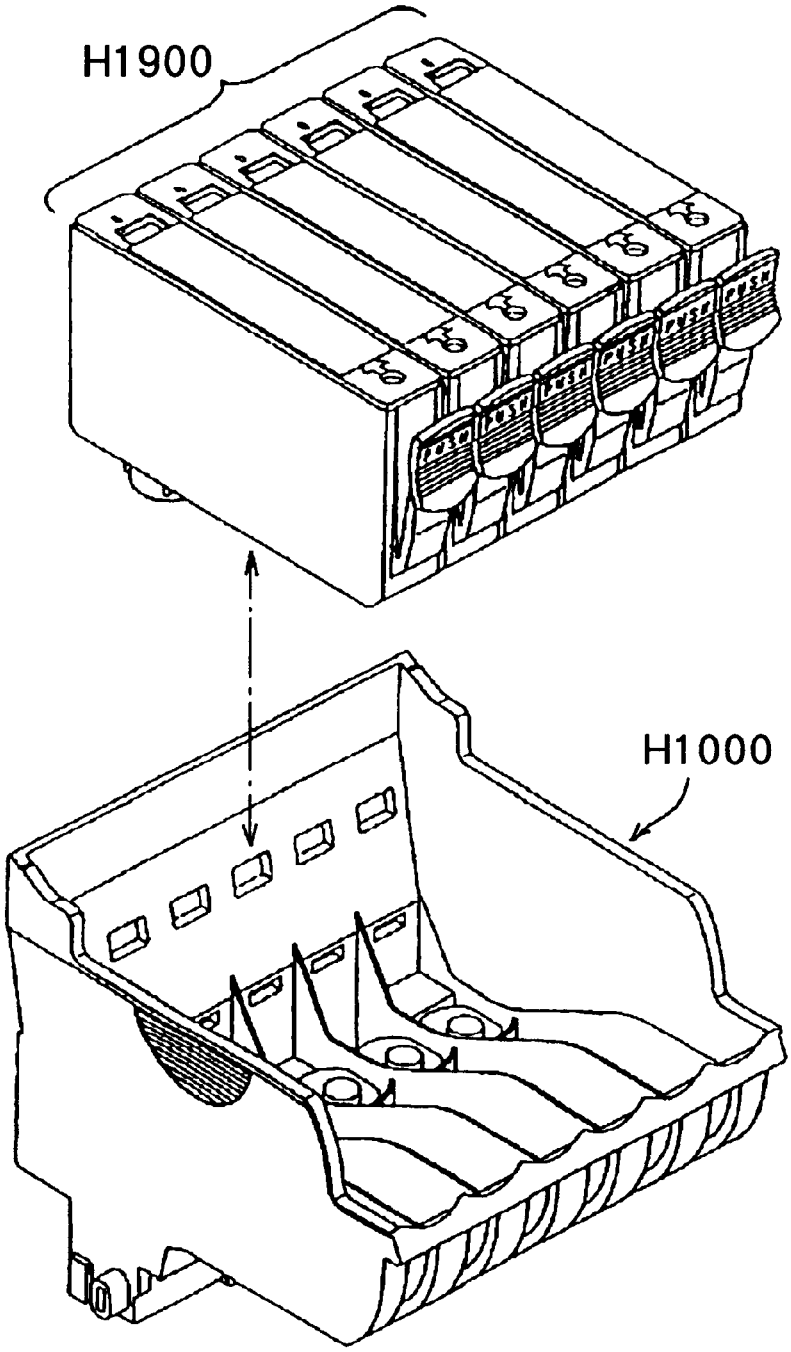
FIG. 4 is a perspective view of the disassembled recording head cartridge into an ink tank and its holder.
Figure 5:
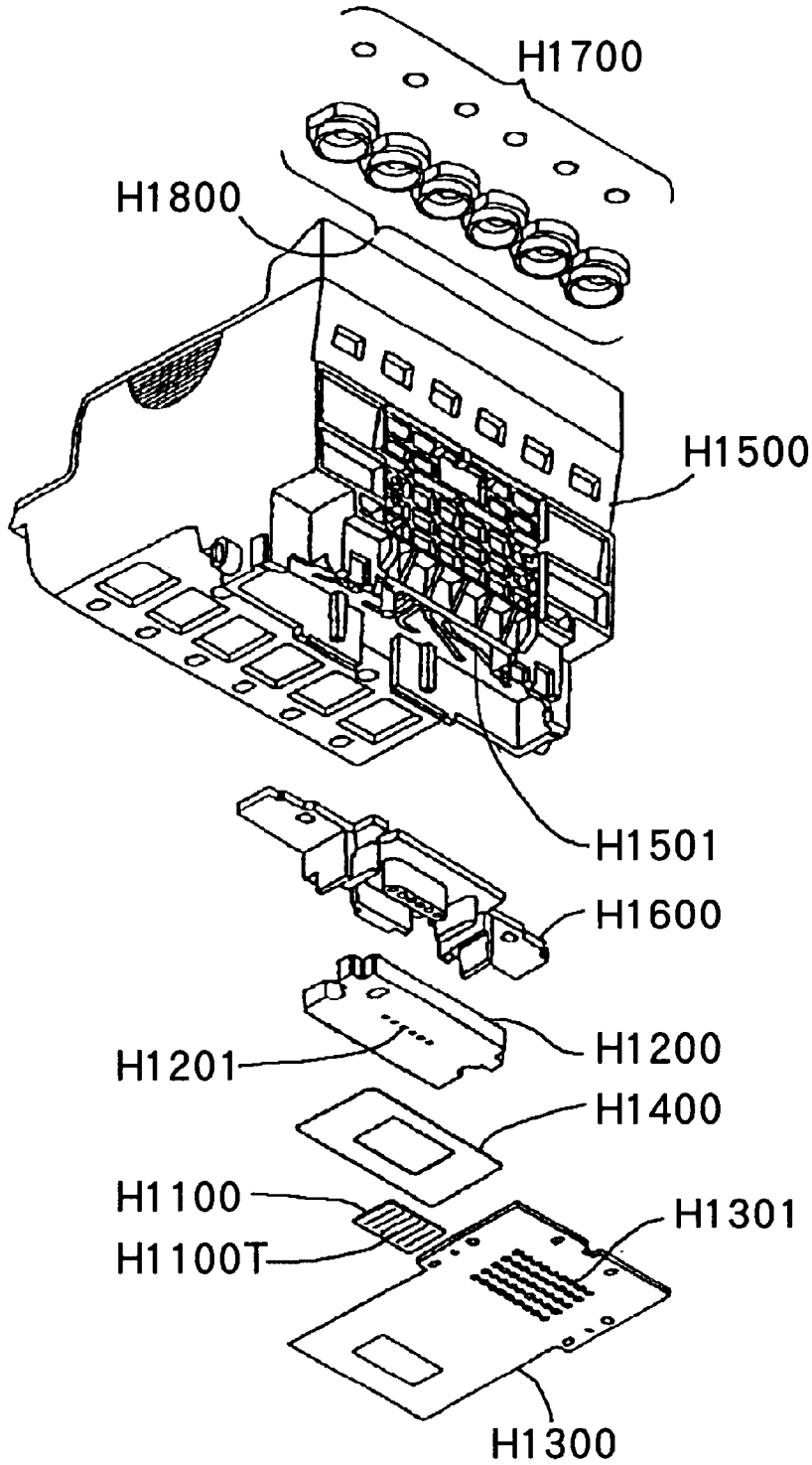
FIG. 5 is a perspective view of the disassembled recording head shown in FIG. 4 viewed from below.

The recording head cartridge is explained according to FIG. 3, FIG. 4 and FIG. 5.

As shown in FIG. 3 the recording head cartridge H1000 in the present embodiments has liquid accommodating containers H1900 for storing ink and a recording head H1001 where ink, supplied from the liquid accommodating containers according to information to be recorded, is ejected via nozzles, and the above-mentioned recording head H1001 is detachably mounted on the carriage M4001 which will be explained later, namely so called a cartridge method is employed.

In the recording head H1000, liquid accommodating containers for respective colors for example such as black, light-cyan, light-magenta, cyan, magenta and yellow containers, are prepared independently so as to be capable of printing photographic images of high quality and containers are detachable to the recording head H1001 as shown in FIG. 4.

As shown in the disassembled perspective view depicted in FIG. 5, the above-mentioned recording head H1001 is constituted of a substrate H1100 for recording elements, a first plate H1200, an electric wiring plate H1300, a second plate H1400, a tank holder H1500, a liquid path forming member H1600, filters H1700 and sealing rubbers H1800.

On one side of the substrate H1100 made of silicon for recording elements, a plurality of recording elements for ejecting ink and electric wiring of Al etc. are formed by a thin film forming technology, and a plurality of ink paths at corresponding positions to the recording elements and a plurality of eject ports H1100T are formed by a photolithographic technology and on the other side of the substrate ink supplying openings for supplying ink to a plurality of liquid paths are formed. The above-mentioned substrate H1100 for recording elements is adhered and fixed to the first plate H1200, where openings H1201 for supplying ink to the substrate H1100 for recording elements are formed. In addition, the second plate H1400 having an opening portion is adhered and fixed to the first plate H1200, and the second plate H1400 holds the electric wiring plate H1300 so that the electric wiring plate H1300 and the substrate H1100 for recording elements are electrically connected. The electric wiring plate H1300 is used for applying electric signals for ejecting ink to the substrate H1100 for recording elements and has corresponding wiring to the above-mentioned substrate H1100 for recording elements and terminals H1301 for receiving external electric signals positioned at ends of the corresponding wiring from the main body of the printer, and above-mentioned terminals H1301 for receiving external electric signals fixed to a determined position at the rear side of the tank holder H1500 which will be explained later.

By a supersonic welding method the liquid path forming member H1600 is fused and fixed to the tank holder H1500 which detachably holds the above-mentioned liquid accommodating containers H1900 so as to form ink paths H1501 extending from the liquid accommodating containers H1900 to the first plate H1200. At the side of the liquid accommodating containers H1900 fitting to the ink paths H1501, filters H1700 are arranged so as to prevent dusts from penetrating into the containers. At connected portions of the ink paths with the liquid accommodating container H1900 sealing rubbers are applied so as to prevent ink from evaporation.

The recording head H1001 is formed by combining a tank holder part; comprised of the tank holder H1500, the liquid path forming member H1600, filters H1700 and sealing rubbers H1800, and a recording element part; comprised of the above mentioned substrate H1100 for recording elements, the first plate H1200, the electric wiring base plate H1300 and the second plate H1400 together with adhesives etc. M2015 in FIG. 2 stands for a lever to adjust a gap between the recording head and the recording sheet.

(Carriage)

Hereinafter the above-mentioned carriage M4001 is explained according to FIG. 2.

As shown in the figure, on the carriage M4001, a carriage cover M4002 which is connected with the carriage M4001 and guides the recording head H1001 to an applying position on the carriage M4001 and a head set lever M4007 with which the tank holder H1500 of the recording head H1001 is connected so as to set the recording head at a predetermined position by pushing the lever, are arranged.

Namely, the head set lever M4007 attached around a head set lever axis is rotatably mounted on the upper portion of the carriage M4001 and a unshown head set plate is arranged at the connected portion of the recording head H1001 via a spring which pushes the recording head so as to be fixed on the carriage M4001.

At another connected portion of the carriage M4001 with the recording head H1001, a contact flexible printed cable (hereinafter referred as "contact FPC") E0011 (see FIG. 7) is formed so that a contacting portion of the contact FPC E0011 and a contact portion (input terminals for outside signals) H1301 are electrically contacted so as to transfer various information for recording and to supply power to the recording head H1001.

Between the contact portion of the contact FPC E0011 and the carriage M4001 an unshown elastic member such as a rubber etc. is formed so as to ensure the contact between the contact portion and the carriage M4001 with an elastic force from the elastic member and a pressing force from the head lever set spring. The above-mentioned contact FPC E0011 is also connected with a carriage base plate E0013 (see FIG. 7) mounted on the rear side of the carriage M4001.

(Scanner)

The printer in the present embodiment can be used as a reading apparatus when the recording head is replaced by a scanner.

The scanner moves along with the carriage of the printer and reads a provided image copy in stead of a recording medium in a sub-scanning direction, and by repeating reading and feeding the copy alternatively, and thus the entire copy of image information can be read.

Figure 6B:
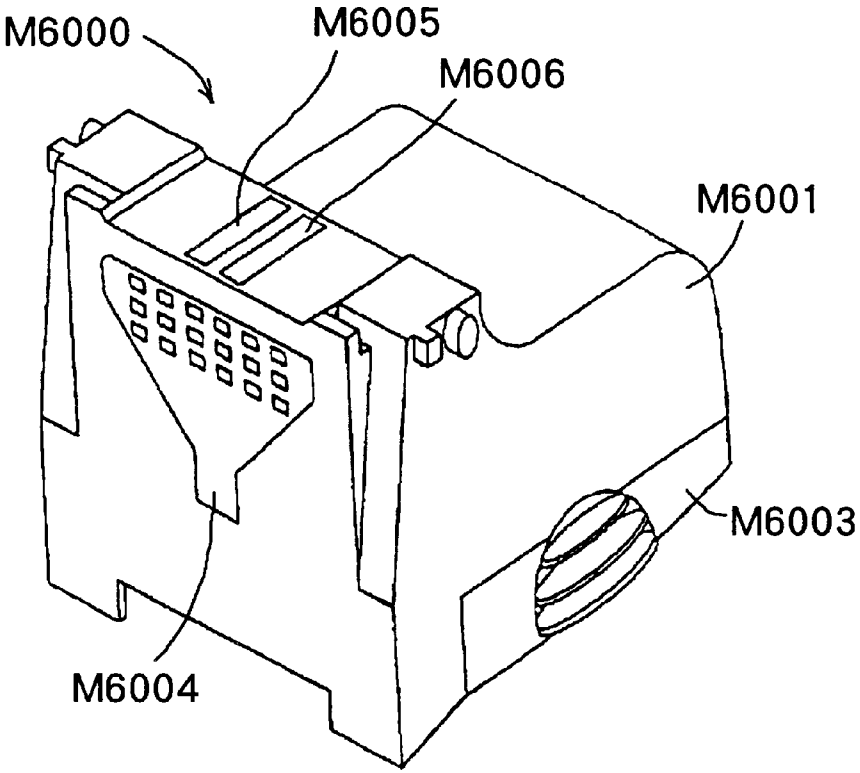
FIG. 6A and FIG. 6B are perspective views of a scanner cartridge, where
Figure 6A:
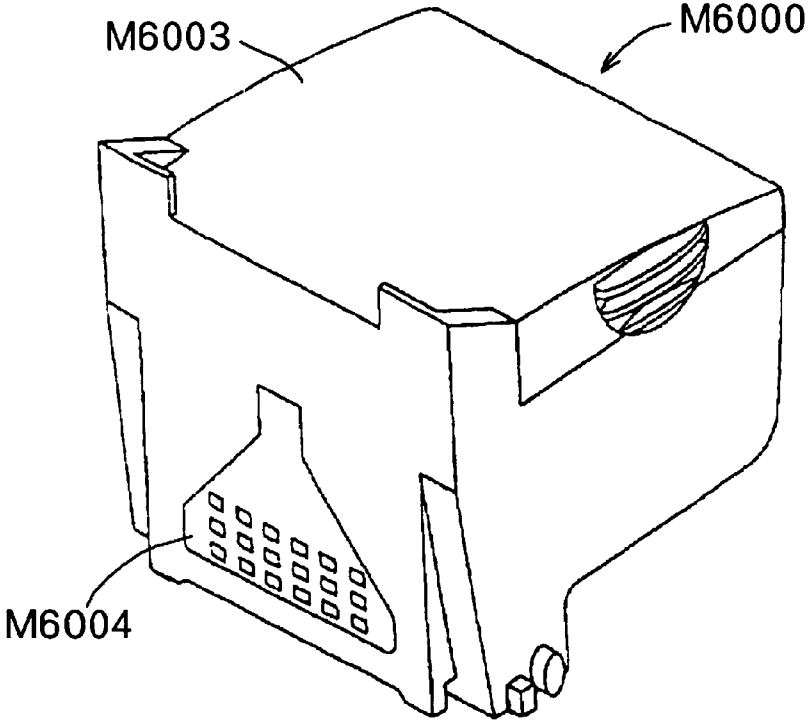

FIG. 6A and FIG. 6B show an outline of a scanner M6000.

As shown in the figures a scanner holder M6001 bears a box like shape where an optical system and a processing circuit required for reading are accommodated inside. On a position of the scanner M6000 facing the copy to be read, a scanner reading lens M6006 is mounted so as to read the image copy, when it is mounted on the carriage M4001. A scanner lighting lens M6005 having a unshown light source inside, irradiates light from the light source on the copy to be scanned.

A scanner cover M6003 fixed to a bottom part of the above-mentioned scanner holder M6001 is fitted in the holder so as to shut off light into the scanner holder M6001, and its mounting/de-mounting operation on the carriage M4001 is enhanced with the aide of louver like handle members attached to its sides. Since an external shape of the scanner holder M6001 is almost the same shape as the recording head H1001, it can be attached or detached in the same way as in the case of recording head H1001.

In addition, a base plate bearing the above-mentioned processing circuit is accommodated in-the scanner holder M6001 and a scanner contact PCB connected with the base plate is formed outside so that the above-mentioned base plate is electrically connected with a control system in the main body via the contact FPC E0011 of the carriage M4001 with which the above-mentioned scanner contact PCB M6004, when the scanner M6000 is mounted on the carriage M4001.

Hereinafter, a constitution of an electric circuit in the embodiments is explained.

Figure 7:
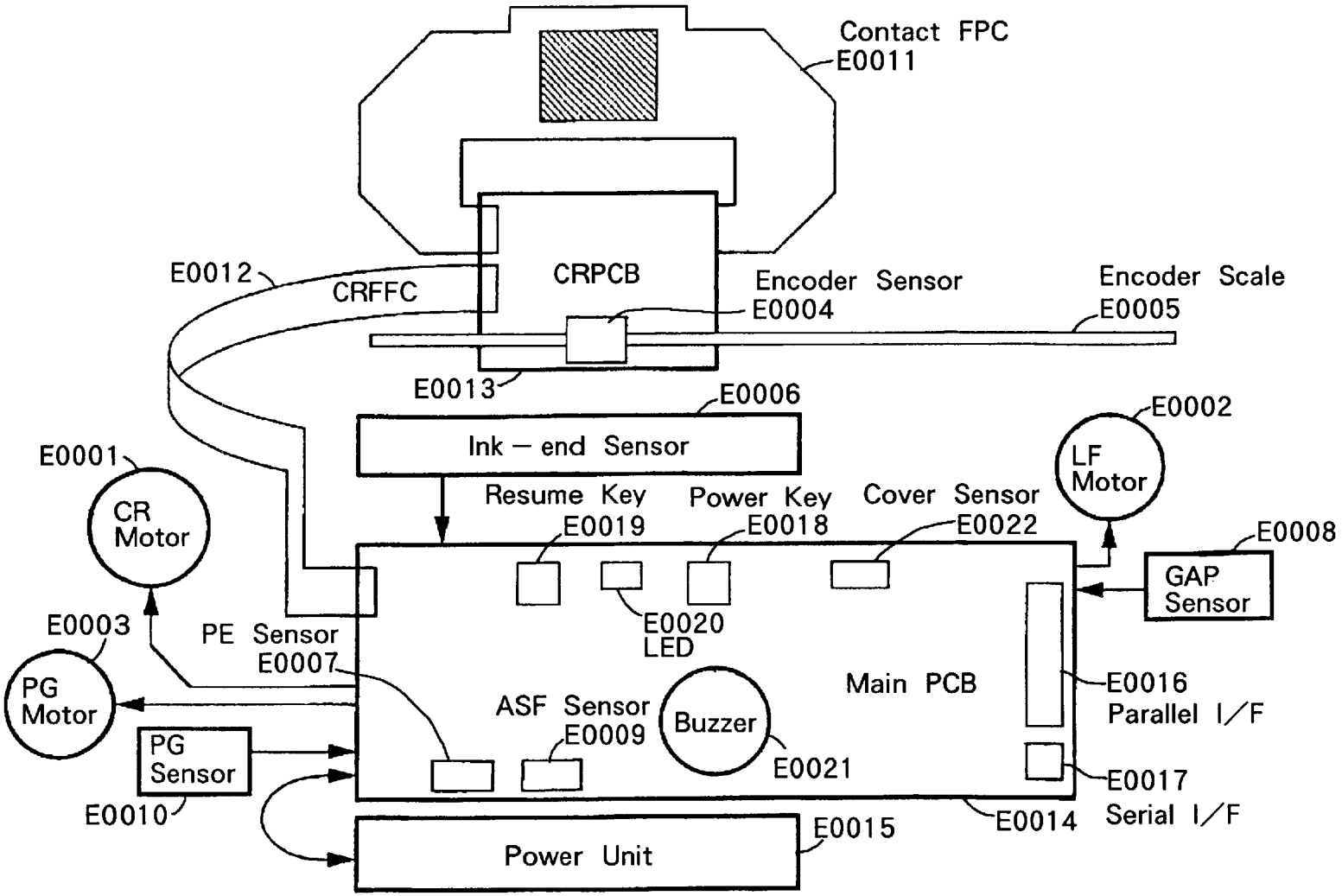
FIG. 7 is a block diagram illustrating a schematic outline of an electrical circuit of an embodiment in the present invention.

FIG. 7 is a block diagram illustrating a schematic outline of the electrical circuit in the embodiments of the present invention.

In the present embodiments the electric circuit is constituted of mainly a carriage printed circuit board (CRPCB) E0013, a main PCB (printed circuit board) E0014 and a power unit E0015 etc.

The above-mentioned power unit is connected with the main PCB E0014 and supplies various driving powers.

The carriage PCB E0013 is a printed circuit board unit mounted on the carriage M4001 (see FIG. 2), not always functions as an interface which transfers signals between the recording head via the contact FPC E0011, but also detects a position change of a CR encoder sensor E0004 against a CR encoder scale E005 based on a pulse signal outputted from the CR encoder sensor E0004 according to a movement of the carriage M4001 and outputs the outputted signal to the main PCB E0014 via a flexible flat cable (CRFCC) E0012.

The main PCB, as a printed circuit board unit which controls various driving devices in the ink-jet printer in the present embodiments, has an I/O port for a paper end detection sensor (PE sensor) E007, an ASF sensor E009, a cover sensor E0022, a parallel interface (parallel I/F) E0016, a serial interface (serial I/F) E0017, the resume key E0019, the LED E0020, the power key E0018 and a buzzer E0021 etc. on it, and further is connected with and controls a CR motor E0001, an LF motor E0002 and a PG motor E0003, and has interfaces connected with an ink end sensor E0006, a GAP sensor E0008, a PG sensor E0010, the CRFFC E0012 and the power unit E0015.

Figure 8:
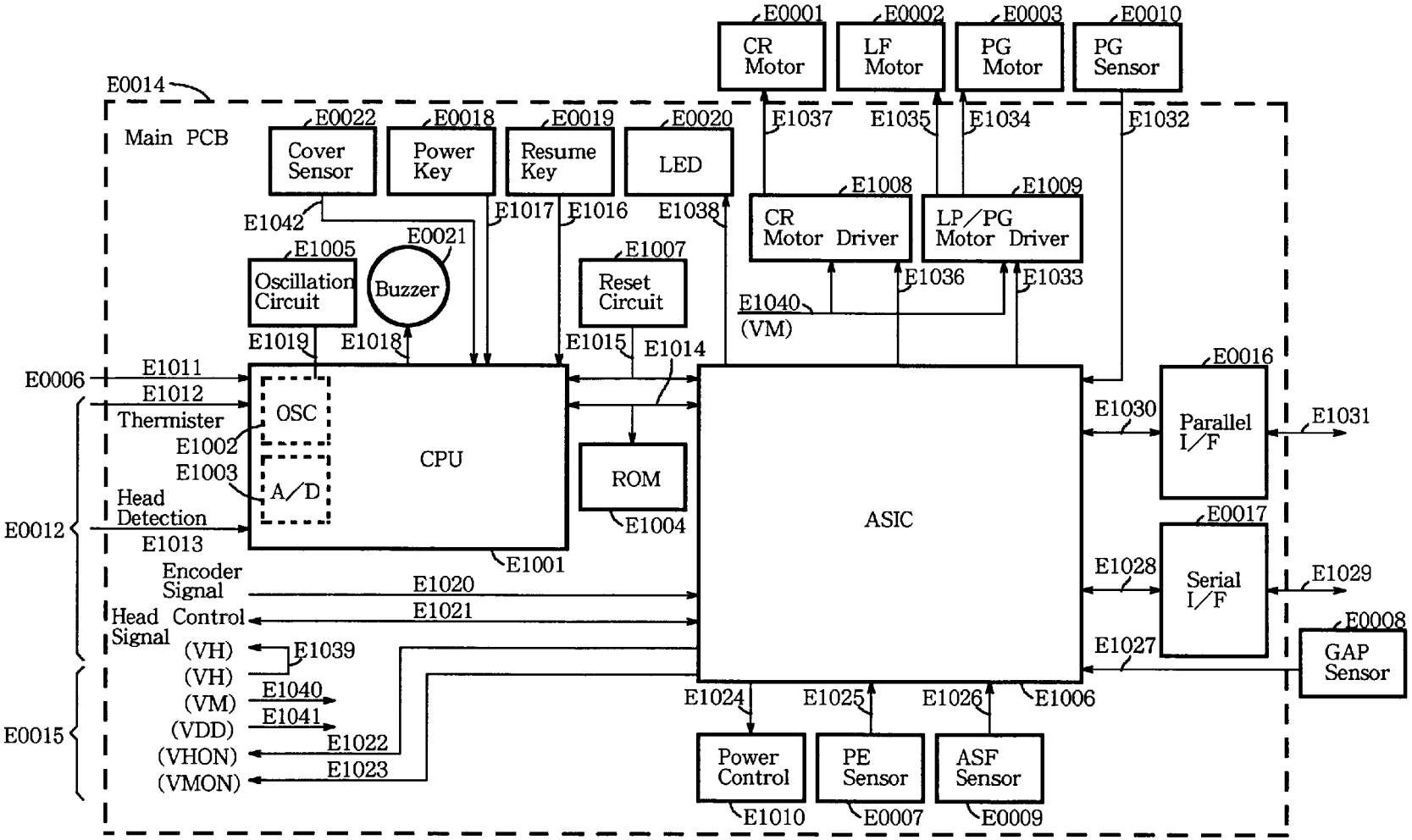
FIG. 8 is a block diagram illustrating an interior constitution of the main PCB in FIG. 7.

FIG. 8 is a block diagram illustrating an interior constitution of the main PCB.

In the figure, E1001 stands for a CPU that has an oscillator OSC E1002 inside and is connected with an oscillation circuit E1005 so as to generate a system clock according to an outputted signal E1019 from the oscillation circuit. The CPU is also connected with a ROM E1004 and an ASIC (Application Specific Integrated Circuit) E1006 via a control bus E1014 so that the CPU controls the ASIC, detects an inputted signal E1017 from the power key, an inputted signal E1016 from the resume key, a cover detection signal E1042 and a head detection signal (HSENS) E1013 according to programs stored in the ROM, further activates the buzzer E0021 in response to a buzzer signal (BUZ) E1018, detects an ink end detection signal (INKS) E1011 connected with a built-in A/D converter E1003 and a thermistor temperature detection signal (TH) E1012 and executes various logic operations and conditional decisions etc., thus commands driving and controlling the inkjet printing apparatus.

The head detection signal E1013 means an inputted head mounting detection signal from the recording head cartridge H1000 via the flexible flat cable E0012, carriage PCB E0013 and the contact flexible printed cable E0011. The ink end detection signal is an analog signal outputted from the ink end sensor E0006. The thermistor temperature detection signal E1012 is an analog signal from a thermistor (not shown) mounted on the carriage PCB E0013.

E1008 stands for a CR motor driver which uses a motor power source (VM) E1040 as a driving power, and generates a CR motor drive signal E1037 according to a CR motor control signal E 1036 from the ASIC E1006 so as to drive the CR motor E0001. E1009 stands for an LFIPG motor driver which uses the motor power source E1040 as a driving power, generates an LF motor drive signal E1035 according to a pulse motor control signal E1033 (PM control signal) from the ASIC E1006 so as to drive the LF motor and generates a PG motor drive signal E1034 so as to drive the PG motor.

E1010 is a power control circuit that controls a power supply to respective sensor etc. having light emitting elements according to a power control signal E1024 from the ASIC E1006. The parallel I/F E0016 transmits a parallel I/F signal E1030 from the ASIC E1006 to a parallel I/F cable E1031 to be connected outside and also transmits a signal from the parallel I/F cable E1031 to the ASIC E1006. The serial I/F E0017 transmits a serial I/F signal E1028 from the ASIC E1006 to a serial I/F cable E1029 to be connected outside and also transmits a signal from the cable E1029 to the ASIC E1006.

The above-mentioned power unit E0015 supplies a power for the head (VH) E1039, a power for motors (VM) E1040 and a power for LSI (VDD) E1041. A power-on signal for the recording head (VHON) E1022 and a power-on signal for motors (VMON) E1023 from the ASIC E1006 are inputted into the power unit E0015 which then controls power-on/off of the power for the recording head E1039 and the power for motors E1040. The power for LSI (VDD) E1041 supplied from the power unit E0015 is supplied to devices inside and outside of the main PCB E0014 after adjusting voltage, if required.

The power for the recording head E1039 is transmitted to the flexible flat cable E0011 after smoothed the power and is used for driving the recording head cartridge H1000.

E1007 is a reset circuit that detects a lowered status of the power for LSI E1040, transmits reset signals (RESET) E1015 to the CPU E1001 and the ASIC E1006 and initializes them.

The ASIC E1006, a one-chipped semiconductor integrated circuit controlled by the CPU E1001 via the control bus E1014, outputs the above-mentioned CR motor control signal E1036, the PM control signal E1033, the power control signal E1024, the power-on signal E1022 for recording head and the power-on signals E1023 for motors etc., not only exchanges signals with the parallel I/F E0016 and the serial I/F E0017, but also detects a PE detection signal (PES) E1025 from the PE sensor E0007, an ASF detection signal (ASFS) E1026 from the ASF sensor E0009, a GAP detection signal (GAPS) E1027 from the GAP sensor E0008 and a PG detection signal (PGS) E1032 from the PG sensor E0010 and transmits these detected status data to the CPU E1001 via the control bus E1014, then the CPU E1001 blinks the LED E0020 by controlling the LED drive signal E1038 according to the transmitted data.

The ASIC also detects an encoder signal (ENC) E1020 and generates a timing signal so as to control a recording movement by interfacing between the head control signal E1021 and the recording head cartridge H1000. Here the encoder signal (ENC) E1020 means an outputted signal from the encoder sensor E0004 (see FIG. 7), inputted via the flexible flat cable E0012. The head control signal E1021 is transmitted to the recording head H1001 via the flexible flat cable E0012, the carriage PCB E0013 and the contact FPC E0011 (see FIG. 7).

Figure 9:
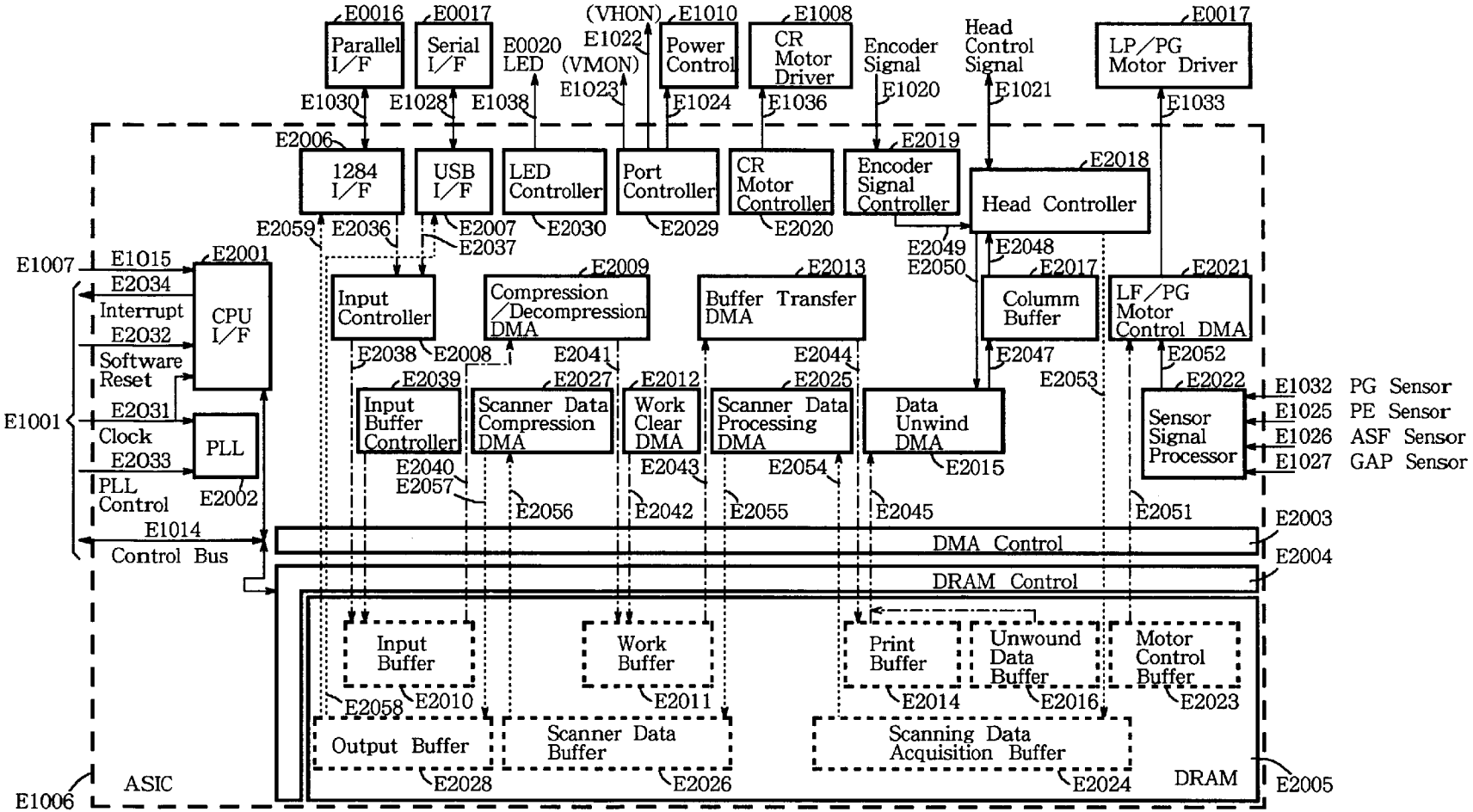
FIG. 9 is a block diagram illustrating an interior constitution of the ASIC in FIG. 8.

FIG. 9 is a block diagram illustrating an interior constitution of the ASIC E1006.

In the figure, only data flows such as registered data and motor controlling data relating to controlling the head and respective active members, are depicted to show relations among respective blocks, and on the other hand controlling data relating to reading/writing registers in each block, clock signals and signals relating to controlling DMA control are omitted in order to avoid a complication in the drawing.

In the figure E2002 is a PLL which generates clocks (not shown) to be supplied almost all portion of the ASIC E1006 according to an outputted clock signal (CLK) E2031 from the CPU E1001 and a PLL control signal (PLLON) E2033.

E2001 is a CPU interface (CPUI/F) that controls writing registers in respective blocks as explained hereafter, supplies clocks to some blocks, accepts interrupt signals (These are not shown in the figure.) and so on, and then outputs an interrupt signal (INT) E2034 so as to inform interrupt generations in the ASIC E1006, by a reset signal E1015, a software-reset signal (PDWN) E2032 from the CPU E1001, the clock signal (CLK) E2031 and a control signal from the control bus E1014.

E2005 stands for a DRAM that has respective memory areas for an input buffer E2010, a work buffer area E2011, a print buffer E2014 and an unwound data buffer E2016 used as data buffers for recording, a motor control buffer E2023 as a control buffer for motors and also has respective corresponding memory areas for scanning operations in place of printing operations such as a scanner data acquisition buffer E2024, a scanner data buffer E2026 and an output buffer E2028 etc.

The DRAM E2005 is also used as a work area necessary for movements of the CPU E1001. In other words, E2004, a DRAM control area switches an access from the CPU E1001 to the DRAM E2005 via the control bus into an access from a DMA control area E2003, which will be explained later, to the DRAM E2005 and reads/writes data in the DRAM E2005.

The DMA control area E2003 receives requests (not shown) from respective blocks (not shown) and outputs address signals, control signals and written data (E2038, E2041, E2044, E2053, E2055, E2057) to the DRAM control area during a writing operation, thus access operation to the DRAM is performed. During a reading operation, the DMA control area transmits read out data (E2040, E2043, E2045, E2051, E2054, E2056, E2058, E2059) from the DRAM control area E2004 to respective originally requested blocks.

E2006 stands for a 1284I/F that not only has a role of a mutual communication interface with not shown host devices outside via the parallel I/F E0016, controlled by the CPU E1001 via the CPUI/F E2001, but also during recording operations, transmits received data (a PIF received data E2036) from the parallel I/F E0016 to an input controller E2008 by the DMA processing and also during scanning operations transmits a stored data (a 1284 transmission data (RDPIF) E2059) in an output buffer E2028 to the parallel I/F by the DMA processing.

E2007 stands for a USBI/F that not only has a role of a mutual communication interface with not shown host devices outside via the serial I/F E0017, controlled by the CPU E1001 via the CPUI/F E2001, but also during printing operations transmits received data (a USB received data E2037) from the serial I/F E0017 to the input controller E2008 by the DMA processing and also during scanning operations transmits a stored data (a USB transmission data (RDUSB) E2058) in an output buffer E2028 to the serial I/F E0017 by the DMA processing. The input controller E2008 transfers and writes a received data (WDIF) from the selected I/F, either 1284I/F E2006 or USBI/F E2007, to a writing address for input buffer controlled by the input buffer controller E2039.

E2009 stands for a compression/decompression DMA that reads out received data (raster data) stored in the input buffer E2010 from a read out address for input buffer controlled by the input buffer controller E2039 under the control of the CPU E1001 via a CPUI/F E2001, and compresses/decompresses the read out data (RDWK) according to an specified mode, then transfers and writes the data as a recorded code column (WDWK) E2041 into the work buffer area.

E2013 stands for a recorded buffer transfer DMA that reads out recorded codes (RDWP) E2043 on the work buffer E2011 controlled by the CPU E1001 via the CPUI/F E2001, and arranges the read out codes in order of data transfer to the recording head cartridge H1000 on address in a print buffer E2014 and transfer arranged data (WDWP E2044). E2012 stands for a work clear DMA that repeatedly transfers and writes specified work file data (WDWF) E2042 in the area on the work buffer where the recorded data transfer is finished by a buffer transfer DMA E2015 under the control of the CPU E1001 via the CPUI/F E2001.

E2015 stands for a recorded data unwind DMA that reads out arranged recorded codes on the print buffer and unwinding data written on the unwound data buffer E2016 by a data unwinding timing signal E2050 as a trigger signal under the control of the CPU E1001 via the CPUI/F E2001, generates an unwound recorded data E2045 and writes the generated data on a column buffer E2017 as a column buffer inputted data (WDHDG) E2047. The column buffer E2017 is an SRAM where transferring data (unwound recorded data) are temporally stored and commonly administered by both blocks, the recorded data unwind DMA and a handshake signal (not shown) from a head controller.

E2018 is a head controller that not only interfaces with the head cartridge H1000 or the scanner via the head control signal under the control of the CPU E1001 via CPUI/F E2001, but also outputs a data unwind timing signal E2050 against the recorded data unwind DMA according to a head drive timing signal E2049 from the encoder signal controller E2019.

During printing operations the head controller reads out an unwound recorded data (RDHD) E2048 according to the above-mentioned head drive timing signal E2049 and outputs the read out data to the recording head cartridge H1000 via the head control signal E1021.

In scanner reading modes the head controller DMA transfers inputted acquired data (WDHD) E2053 via the head control signal E1021 to the scanning data acquisition buffer E2024 on the DRAM E2005. E2025 stands for a scanner data processing DMA that reads out acquired buffer read out data (RDVA) E2054 stored in the scanning data acquisition buffer E2024, and transfers and writes processed data (WDAV) such as averaged data etc. into a scanner data buffer E2026 on the DRAM E2005.

E2027 stands for a scanner data compression DMA that reads out and compresses a processed data (RDYC) E2056 on the scanner data buffer E2026 and transfers and writes a compressed data (WDYC) on the output buffer E2028 under the control of the CPU E1001 via the CPUI/F E2001.

E2019 stands for an encoder signal controller that not only outputs the head drive timing signal E2049 according to a specified mode by the control of the CPU E1001 after receiving encoder signals (ENC), but also stores information on a position and a velocity of the carriage M4001 in a register and supplies the information to the CPU E1001. Base on the information, the CPU E1001 determines various parameters in controlling the CR motor E0001. E2020 stands for a CR motor controller that outputs CR motor control signals E1036 under the control of the CPU E1001 via the CPUIIF E2001.

E2022 stands for a sensor signal processor that not only receives respective detected signals outputted from the PG sensor E0010, the PE sensor E0007, the ASF sensor E0009 and the GAP sensor E0008 etc. and transmits these received signals to the CPU E1001 according to a specified mode by the control of the CPU E1001, but also outputs a sensor detected signal E2052 to an LF/PG motor control DMA E2021.

The LF/PG motor control DMA E2021 not only reads out a pulse motor drive table (PDPM) E2051 from a motor control buffer E2023 on the DRAM E2005 and outputs a pulse motor control signal E1033 under the control of the CPU E1001 via the CPUI/F E2001, but also in some operation modes, outputs the pulse motor signal E1033 by one of the above-mentioned detected signals as a trigger to control.

E2030 stands for an LED controller that outputs an LED drive signal E1038 under the control of the CPU E1001 via the CPUI/F E2001. And E2029 stands for a port controller that outputs the head power-on signal E1022, the motor power-on signal E1023 and the power control signal E1024 under the control of the CPU E1001 via the CPUI/F E2001.

Hereinafter, operational movements of the ink-jet printing apparatus constituted in the above-mentioned way in the embodiments of the present invention is explained by referring a flow chart in FIG. 10.

When the apparatus is connected with an AC power source the apparatus start a first initialization as step S1. In this initialization electric circuit systems such as the ROM and RAMs etc. are checked so as to confirm if the apparatus can electrically perform in the normal way.

In step S2 the apparatus judges if the power key E0018 arranged on the upper case M1002 of the main body M1000 of the apparatus is pressed, and if the key is pressed, then goes to step S3 where a second initialization is executed.

In the second initialization respective driving devices and the head system are checked. Namely, it is to confirm if the main body can perform in the normal way when respective motors are initialized and head information is read in.

In step S4 the apparatus waits for events. Namely, instruction events from outside I/Fs, panel key-in events by manual operations and internal control events are supervised against the present apparatus and if some events occur, appropriate actions against the events are executed.

For example, in step S4 when a print instruction event is received from the outside I/F, the present step goes to step S5 where if a power key event by a manual operation occurs, the step jumps to step S10, and in the cases of other events the step jumps to step S11.

In step S5 the printing instruction event from the outside I/F is analyzed and a paper type, a sheet size, printing quality, and a sheet feed method etc. are identified, these identified results are written in the RAM E2005 equipped in the apparatus, then the step goes to step S6.

In step S6 a sheet feed is started in the identified way and sent to a print initiation position, then the step goes to step S7.

In step S7 a recording operation is executed. In this operation recorded data sent from the outside I/F is temporally stored in the print buffer, then the CR motor E0001 is started moving toward the carriage M4001 while the stored recorded data in the print buffer E2104 is supplied to the recording head H1001 and a one line recording is performed, and followed the completion of the one line recording, the LF motor E0002 is driven to rotate LF roller M3001 so as to sent the sheet in a sub-conveying direction. These operations are executed repeatedly until the recorded data fill one page, then the step goes to step S8.

In step S8 the PG motor E0003 is started to drive the paper ejection roller which repeats conveying the sheet until it is confirmed that the sheet is completely out of the present apparatus, then as the completion of ejection the sheet is on the paper ejection tray M1004*a*.

In the next step S9 status whether the recording operation on whole pages are completed or not, is judged, if some pages to be recorded are left, the step returns to step S5 and steps from S5 to S9 are repeated until the recording operation on the whole pages is completed, then the printing operation is completed and the step returns to step S4 so as to await the next event.

In step S10 a print ending operation is executed to stop the movement of the present apparatus. Namely, the power to various motors and the head etc. are cut off after the system is brought to a status where the power can be cut off, then the step goes to step S4 so as to await the next step.

In step S11 other events except described above are executed. For example, operations in response to events such as restore instructions from various panel keys of the present apparatus and outside I/Fs, and internally generated restoring events etc. are executed. After the operations are completed the step goes to step S4 so as to await the next event.

Hereinafter embodiments of the present printing apparatus are explained in detail based on several examples by referring drawings.

Embodiment 1

Figure 11A:
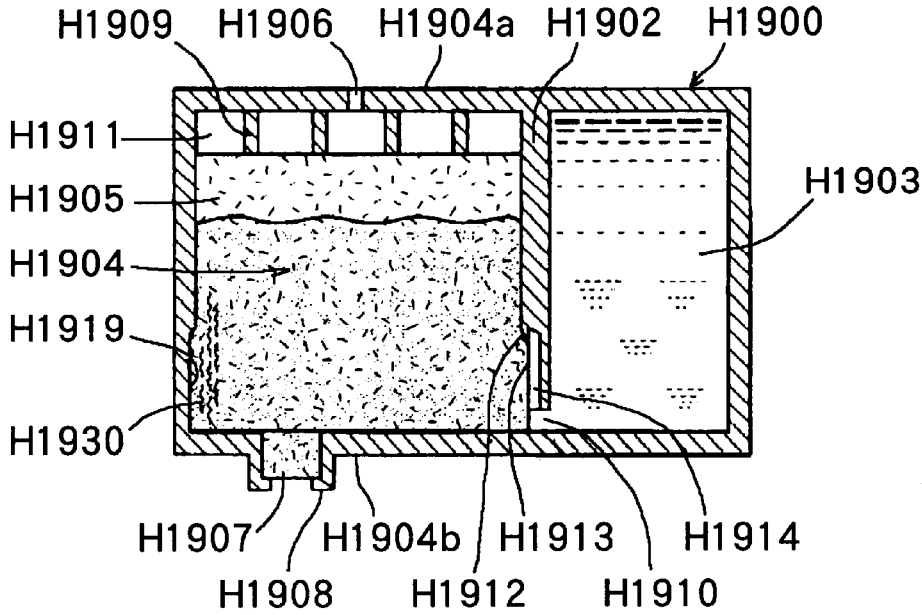
FIG. 11A and FIG. 11B show an ink tank in a printing apparatus of the embodiment 1 in the present invention, where
Figure 11B:
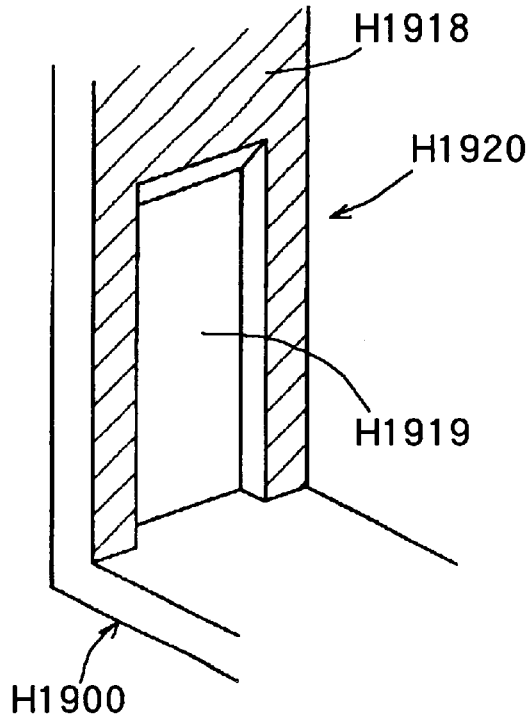

FIG. 11 shows an ink tank in a printing apparatus of the embodiment 1 in the present invention, where FIG. 11A is a longitudinal sectional view and FIG. 11B is a perspective view of partially enlarged surface facing a separating wall.

As shown in FIG. 11A in the ink tank of embodiment 1 of the printing apparatus of the present invention, as a liquid accommodating container, an 28 ink tank H1900 is separated by a separating wall H1902 into a liquid accommodating compartment H1903 and a negative pressure generating member accommodating compartment H1904, where the liquid accommodating compartment H1903 and the negative pressure generating member accommodating compartment H1904 are connected each other via a connecting opening H1910 formed at the lowermost portion of the separating wall E1902 as depicted at the bottom portion in the embodiment 1. In the liquid accommodating compartment H1903, liquid such as ink is accommodated and in the negative pressure generating member accommodating compartment H1904, a negative pressure generating member H1905 like a fibrous absorber comprised of, for example, fibers of polyolefine reins such as polyethylene resin etc. is accommodated.

In addition, on a top wall H1904*a* of the negative pressure generating member accommodating compartment H1904 of the ink tank H1900, not only an opening H1906 to the air is formed, but also a plurality of suspending ribs H1909 are formed with some spaces apart so as to constitute a plurality of buffer compartments H1911. And on a bottom portion H1904*b* of the negative pressure generating member accommodating compartment H1904, an opening H1908 for supplying ink to the recording head is formed and there an ink exporting member H1907 is filled. The opening H1908 for ink supply is, for example, constituted so as to fit in the recording head.

At a lower portion of the separating wall H1902 of ink tank H1900 immediately above the connecting opening H1910, an air importing member H1912 is formed. The air importing member H1912 is comprised of a negative pressure relaxing portion H1913 and air importing grooves H1914, where the negative pressure relaxing portion H1913 is formed by arranging concave portions etc. and beyond the negative pressure relaxing portion H1913, a plurality of the air importing grooves H1914 extending longitudinally are formed. As shown in the figure, the air importing grooves H1914 on the separating wall H1902 exerts a repulsive force so as to press the negative pressure generating member H1905 by protruding portions formed among the air importing grooves H1914.

On a wall opposite to the separating wall H1902 and at a lower portion of a contact surface H1918 with which the negative pressure generating member H1905 contacts, a concave portion H1919 is formed so as to relax a contact status of the negative pressure generating member H1905.

The concave portion H1919 is shown in FIG. 11B in a detailed enlarged state. Namely, a contact relaxing portion H1920 is formed by the contact surface H1918 with the negative pressure generating member H1905 such as the fibrous absorber etc. and by the concave portion H1919 for relaxing the contact status with the negative pressure generating member H1905, where a portion of the negative pressure generating member H1905 in the vicinity of the contact relaxing portion H1920 forms a relaxation area H1930. The contact surface area with the negative pressure generating member H1905 is the contact surface H1918 depicted by the hatching in the figure, where the contact status of the negative pressure generating member H1905 is relaxed by the corresponding area to the concave portion H1919 compared with the case where the concave portion is not formed, and in this embodiment the contact surface area is formed smaller than the contact surface area of the negative pressure generating member H1905 with the separating wall H1902 in the vicinity of the negative pressure relaxing portion H1913 where the air importing grooves H1914 of the air importing portion H1912 is formed. By forming the concave portion, the repulsive force from the opposite wall to the separating wall H1902 i.e. from the contact surface H1918 against the negative pressure generating member H1905 is increased so that a portion of the negative pressure generating member H1905 in the vicinity of the concave portion H1919 is collapsed.

As a result of the collapsed portion of the negative pressure generating member H1905 in the vicinity of the concave portion H1919, a collapse at the portion of the negative pressure generating member H1905 in the vicinity of the air importing portion H1912 is relaxed so that the poor ink supply described in the section of "Brief Description of the Related Arts" does not occur anymore. The concave portion H1919 should be formed as large as possible, but could be kept a proper size, i.e. a depth expected to attain a sufficient relaxation effect, since there is a probability that air bubbles will deposit at the concave portion, if the portion is too large. At the upper portion of the concave portion H1919 a structure constituted so that unnecessary air paths do not generate due to a closely contacted status between the negative pressure generating member H1905 and the inner wall. However, since the negative pressure generating member H1905 is apt to be moved by an impact when the concave portion H1919 is too deep, it is preferable to keep the depth at a certain range so as to suppress such phenomenon.

In this embodiment the contact surface area of the contact surface H1918 is set smaller than the contact surface area of the air importing portion H1912 on the side the separating wall H1902, but how to determine the contact surface area of the contact surface H1918 should be determined by factors such as a maximum size derived from a dispersion of the size, a hardness, a repulsive elasticity of the negative pressure generating member H1905 and properties for supplying required ink, and also a size of the surface area of the separating wall H1902 etc.

Consequently, even if the contact surface area of the contact surface H1918 is formed larger than the contact surface area of the air importing portion H1912, there are no problems as far as ink supply properties are fulfilled, since the collapse of the negative pressure generating member H1905 in the vicinity of the air importing portion H1912 is suppressed by the collapse, to a certain extent, of the portion of the negative pressure generating member H1905 opposite to the separating wall H1902. Forming the corresponding area to the air importing portion H1912 as concave portions H1919 at the contact surface H1918 is a preferable constitution of this embodiment.

Embodiment 2

Figure 12:
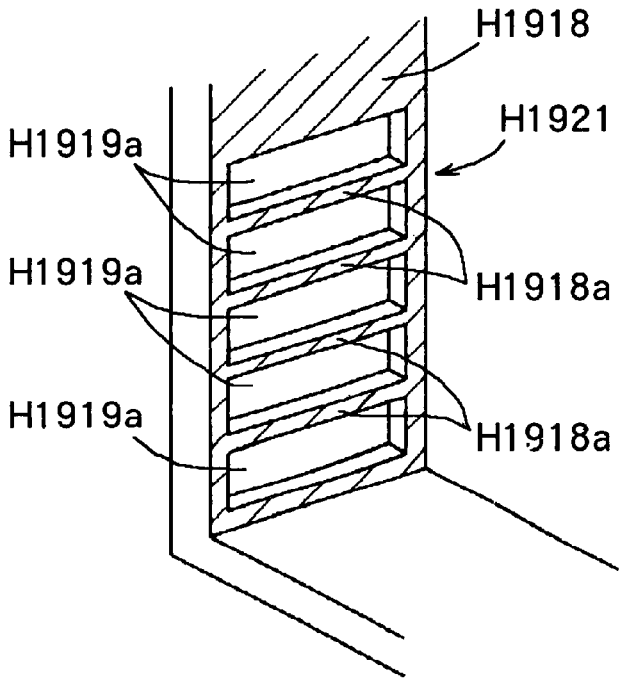
FIG. 12 is a perspective outline illustrating an ink tank in a printing apparatus of the embodiment 2 in the present invention.

FIG. 12 shows a perspective view, same as in FIG. 11B, of partially enlarged portion facing a separating wall of an ink tank in a printing apparatus in the embodiment 2 of the present invention.

As shown in FIG. 12, in this embodiment as in the embodiment 1, a reduced contact surface area H1921 having concave portions H1919*a* is formed, but the structure is different such that a plurality of groove like concave portions H1919*a* extending in a horizontal direction are formed. As a result, virtually a structure with horizontal ribs H1918*a* is formed, so that the following effects are attained.

As shown in FIG. 11, the opening H1908 for ink supply is formed at the bottom portion H1904*b* of the ink tank H1900, and in a case of the ink tank with double compartments where the ink tank H1900 and the recording head H1001 can be separated, it is necessary to push up the ink exporting member H1907 by a supplying pipe constituted on the ink head H1900 a little bit when it is applied in order to ensure a close contact between the ink exporting member H1907 arranged on the opening H1908 for ink supply and the supplying pipe formed on the recording head, as a result a upward force is also applied to the absorber, the negative pressure generating member H1905.

In this case as in the embodiment 2 by forming horizontal ribs H1918*a*, the contact between the ink exporting member H1907 and the supplying pipe is improved compared with the case where no horizontal ribs are formed, since an appropriate friction force is exerted between the inner wall of the ink tank H1900 and the negative pressure generating member H1905, and the friction force works as a repulsive force during the push up movement of the ink exporting member H1907. In addition it is more preferable to form vertical notches and grooves etc. at sites of ribs H1918*a* among concave portions H1919*a*, so that trapped air in the concave portion H1919*a* located between both ribs H1918*a* and H1918*a* can escape upward, thus air is prevented from being trapped in the concave portions H1919*a*. The concave portions work as a constitution which prevent the negative pressure generating member from moving easily when it receives an impact.

Embodiment 3

Figure 13:
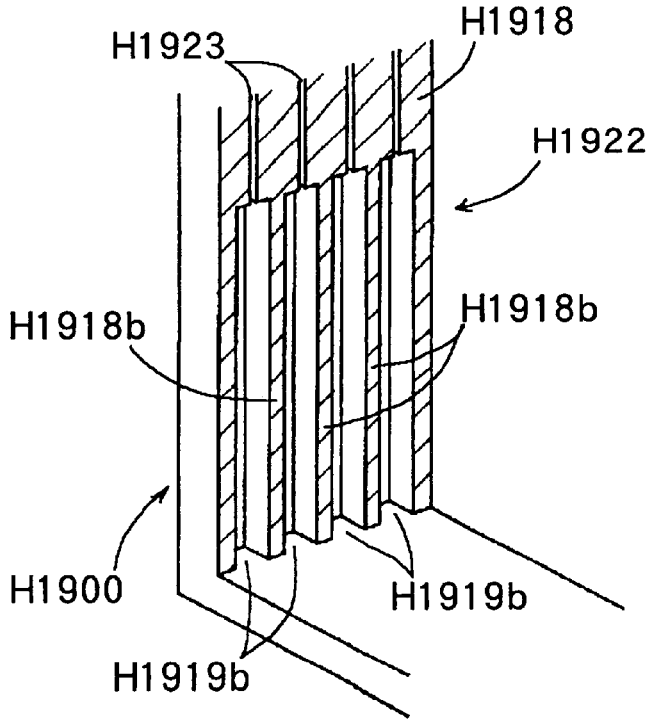
FIG. 13 is a perspective outline illustrating an ink tank in a printing apparatus of the embodiment 3 in the present invention.

FIG. 13 shows a perspective view, same as in FIG. 11B and FIG. 12, of partially enlarged portion facing a separating wall of an ink tank in a printing apparatus of the embodiment 3 in the present invention.

As shown in FIG. 13, in this embodiment as in the embodiments 1 and 2, a reduced contact surface area H1922 is formed, but the structure is different so that the reduced contact surface area H1922 is constituted of a plurality of grooves extending in a vertical direction, where concave portions H1919*b* are formed and connected with air exporting grooves H1923 above. These air exporting grooves H1923*b* lead to an unshown buffer compartment. The ink tank according to this embodiment has not only an effect to suppress a collapse of the negative pressure generating member H1905 in the vicinity of the separating wall H1902 by forming concave portions H1919*b* divided by vertical ribs H1918*b*, but also another effect to remove ink drips caused by the influence of a heat cycle etc.

Namely in the ink tank with double compartments sometimes ink is pushed into the buffer compartment by expanding air included in the negative pressure generating member when the pressure in the ink tank varies in accordance with a change in ambient temperature during transporting the ink tanks and so on. When ink tanks are opened in this status, due to a water head caused by free ink in the buffer compartment, unexpected ink drips from the opening for supplying ink might occur.

However, this embodiment has the effect to remove the ink drip by actively discharging air trapped in the negative pressure generating member H1905 into the buffer compartment H1911 via air exporting grooves H1923.

By constituting in the above-mentioned ways according to the present invention, in the ink tank with double compartment where the fibrous absorber is employed as the negative pressure generating member, the ink tank with stable ink supply is attained by suppressing the collapse of the negative pressure generating member as the absorber in the vicinity of the air importing portion.

Embodiment 4

Figure 14A:
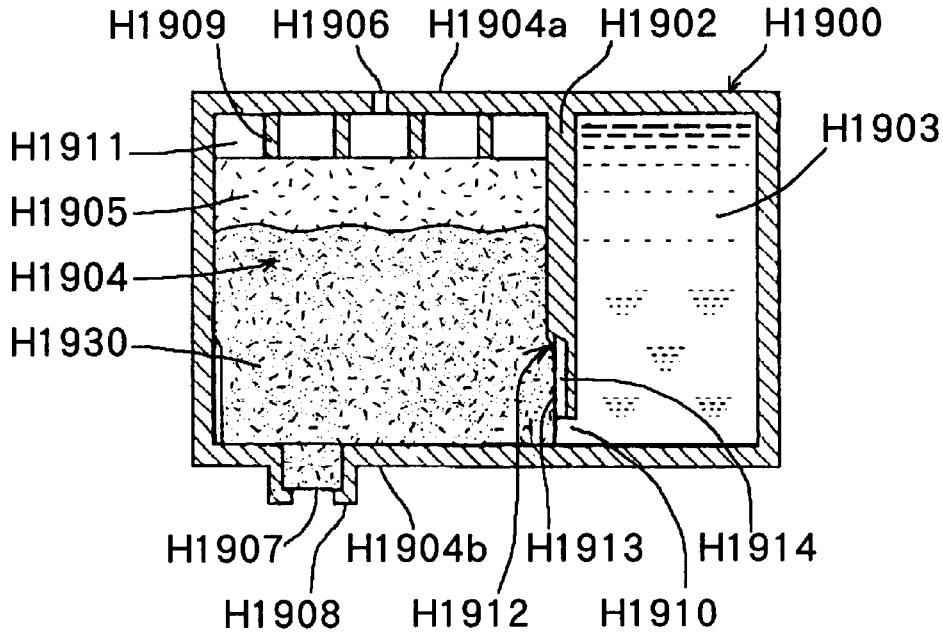
FIG. 14A and FIG. 14B are a perspective outline illustrating an ink tank in a printing apparatus of the embodiment 4 in the present invention where
Figure 14B:
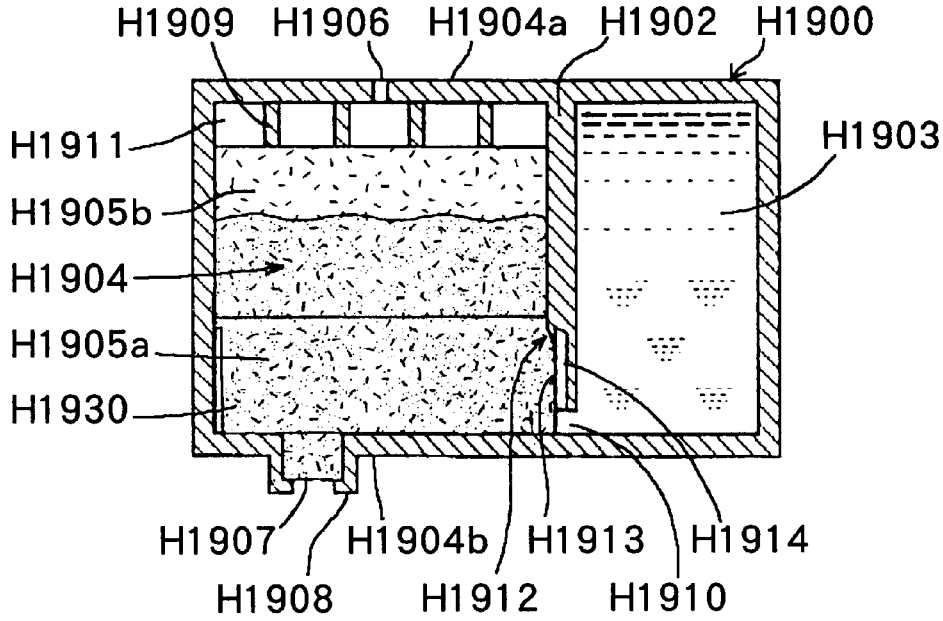
Figure 15:
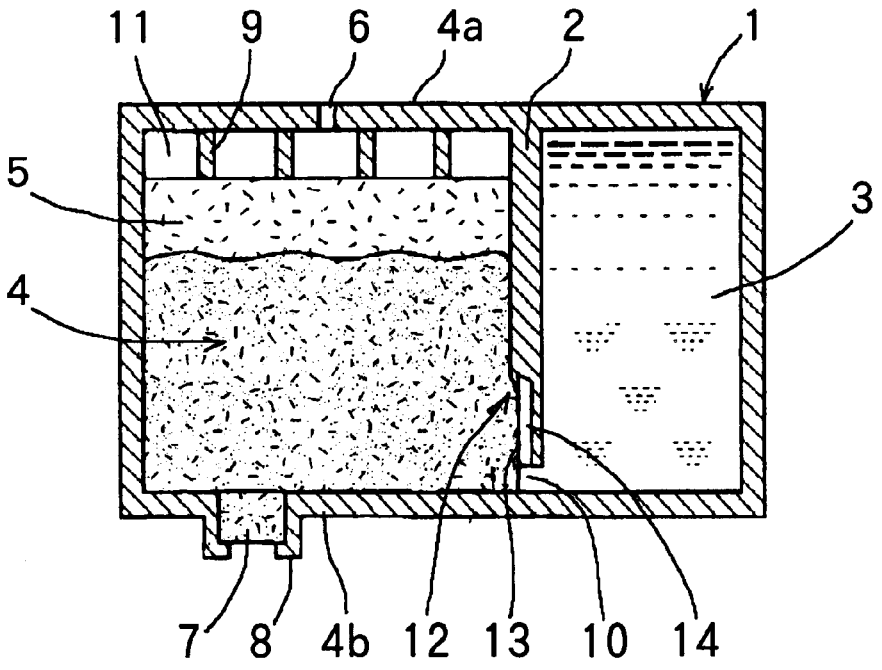
FIG.15 (PRIOR ART)
FIG. 15 is a cross-sectional outline of an ink tank in a conventional printing apparatus.
Figure 16A:
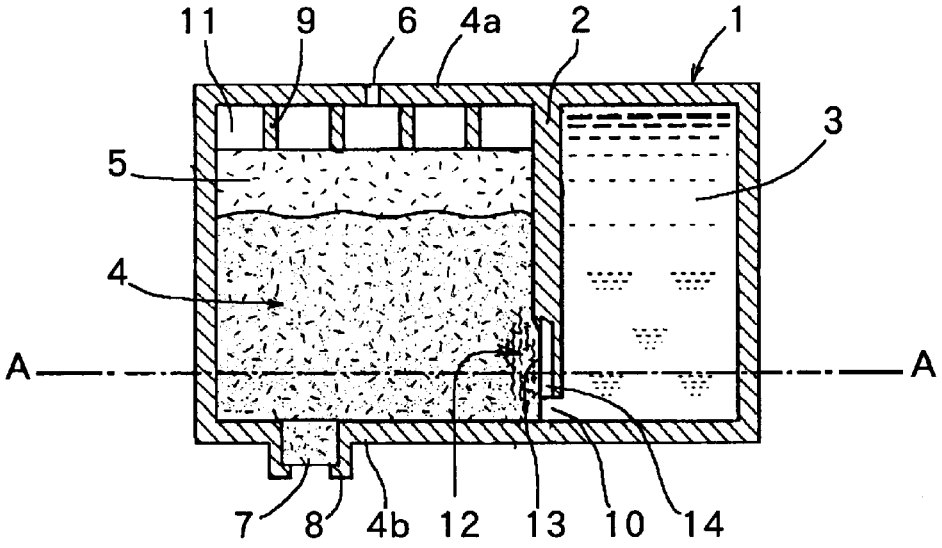
FIG.16A (PRIOR ART)
FIG. 16A and FIG. 16B depict problems to be solved in a conventional printing apparatus, where
Figure 16B:
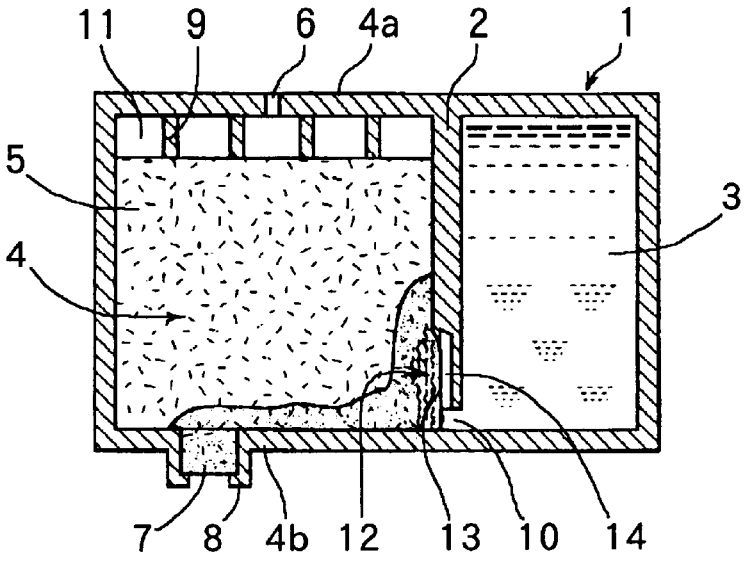
FIG.16B (PRIOR ART)
Figure 17A:
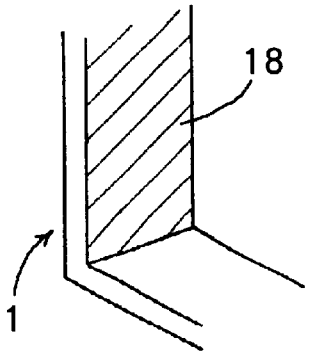
FIG.17A (PRIOR ART)
FIG. 17A, FIG. 17B and FIG. 17C depict outlines of problems to be solved in FIG. 16, where
Figure 17B:
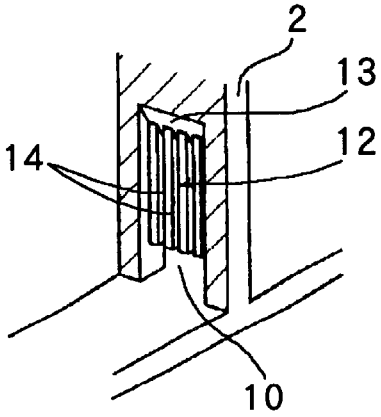
FIG.17B (PRIOR ART)
Figure 17C:
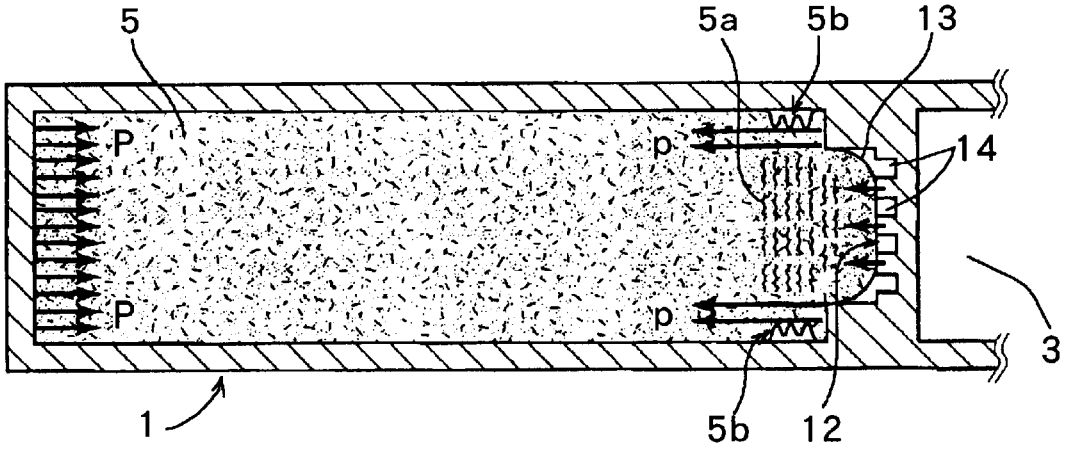
FIG.17C (PRIOR ART)

FIG. 14A and FIG. 14B are cross sectional views of other constitution according to the present invention. FIG. 14A shows a constitution where a relaxation area is constituted between the inner wall and the negative pressure generating member H1905, by partially cutting the fibrous absorber consisting of the negative pressure generating member H1905 facing a side surface opposite to the air importing portion H1912 of the ink tank with double compartments or by deforming the negative pressure generating member (fibrous absorber) when constituted. FIG. 14B shows another constitution where the negative pressure generating member H1905 to be accommodated in the ink tank is comprised two portions, namely, H1905*a* and H1905*b* and a relaxation area H1930 are constituted by setting a length of a first negative pressure member H1905*a* is shorter (to a degree to attain the relaxation structure) than a distance between the air importing portion H1912 and the opposite side surface.

In these figures though the relaxation area H1930 of the negative pressure generating member depicted apart from the inner wall for the purpose of a clear explanation of the constitution, even if the negative pressure generating member contacts with inner wall practically no problems occur as far as the above-mentioned relaxation structure is employed.

In these examples though a special care should be taken when the fibrous absorber is inserted into the ink tank at a production site, the function of this embodiment can be compared with constitutions in the embodiments 1 to 3.

In addition one of the methods to utilize present invention in an effective way is to form bubbles generated by film boiling in the liquid by utilizing thermal energy generated from electro-thermal conversion modules.

Since the liquid accommodating container according to the present invention has the means to suppress unnecessary collapse in the negative pressure generating member in the vicinity of the air importing portion, a stable ink supply, namely a good recording quality can be attained due to suppressing the collapse of the negative pressure generating member in the vicinity of the air importing portion.

What is claimed is:

1. A liquid storage tank comprising:

a negative pressure generating member accommodating compartment for accommodating a negative pressure generating member consisting of a fiber material, and having a liquid supplying portion and an atmosphere connecting portion with the atmosphere, a liquid storing compartment for storing liquid to be supplied to the negative pressure generating member accommodating compartment, and having a connecting portion with said negative pressure generating member accommodating compartment and forming an almost closed space, a separating wall separating said negative pressure generating member accommodation compartment from said liquid accommodating compartment and forming said connecting portion and an air importing portion for importing air from said negative pressure generating member accommodating compartment to the liquid accommodating compartment, said air importing portion being formed in the vicinity of said connecting portion, and anti-collapse means to suppress unnecessary collapse in said negative pressure generating member in the vicinity of said air importing portion, said anti-collapse means having a constitution to relax a contact status with a wall facing opposite said separating wall in the vicinity of said air importing portion, said wall having concave portions formed thereon.

2. A liquid storage tank according to claim 1, wherein a contact area of said concave portions with said negative pressure generating member is smaller than a contacting area of said air importing portion with said negative pressure generating member.

3. A liquid storage tank according to claim 1, wherein said concave portions include a plurality of grooves in a vertical direction with an opening for air discharging on a top portion of said tank.

4. A liquid storage tank according to claim 1, wherein said concave portions include a plurality of grooves in a horizontal direction.

5. A liquid storage tank comprising:

a negative pressure generating member accommodating compartment for accommodating a negative pressure generating member consisting of a fiber material, and having a liquid supplying portion and an atmosphere connecting portion with the atmosphere, a liquid storing compartment for storing liquid to be supplied to the negative pressure generating member accommodating compartment, and having a connecting portion with said negative pressure generating member accommodating compartment and forming an almost closed space, a separating wall separating said negative pressure generating member accommodating compartment from said liquid accommodating compartment and forming said connecting portion and an air importing portion for importing air from said negative pressure generating member accommodating compartment to the liquid accommodating compartment, said air importing portion being formed in the vicinity of said connecting portion, and anti-collapse means to suppress unnecessary collapse in said negative pressure generating member in the vicinity of said air importing portion, said anti-collapse means having a constitution to relax a contact status with a wall facing opposite said separating wall in the vicinity of said air importing portion, wherein a portion of said negative pressure generating member adjacent the wall facing opposite said separating wall is deformed.

6. A liquid storage tank according to either of claims 1 or 4, wherein said fiber material is polyolefine resin fiber.

* * * * *

UNITED STATES PATENT AND TRADEMARK OFFICE

CERTIFICATE OF CORRECTION

PATENT NO. : 6,419,349 B1
DATED : July 16, 2002
INVENTOR(S) : Shuzo Iwanaga et al.

Figure 10:
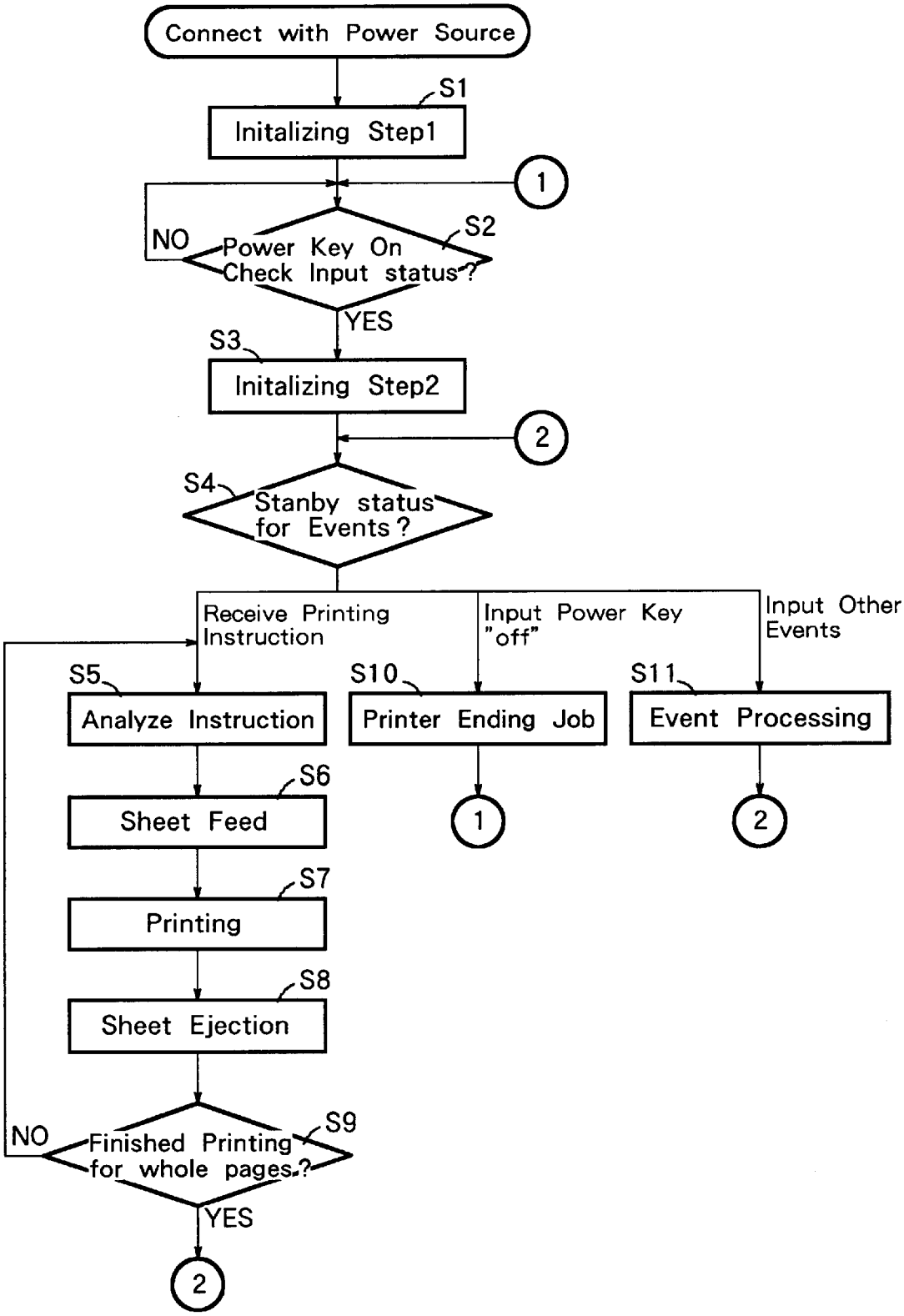
FIG. 10 is a flow chart illustrating an operational procedure of an embodiment in the present invention.

It is certified that error appears in the above-identified patent and that said Letters Patent is hereby corrected as shown below:

Drawings,
Sheet 10, FIG. 10, "Initalizing" (both occurrences) should read -- Initializing --.

Column 1,
Lines 28, 39 and 49, "referred" should read -- referred to --; and
Lines 66 and 67, "a" (first occurrence) should read -- an --.

Column 2,
Line 13, "referred" should read -- referred to --;
Line 31, "pressure." should read -- pressure --;
Line 32, "a" should read -- an --; and
Line 59, "aide" should read -- aid --.

Column 3,
Line 3, "inner than" should read -- inside --;
Line 20, "with" should be deleted;
Line 33, "applicant" should read -- applicants --;
Line 34, "so" should read -- as --;
Line 43, "2 When" should read -- ¶ ② When --; and Line 62, "is" (second occurrence) should be deleted.

Column 4,
Line 8, "that" should read -- the fact that --;
Line 11, "a too significant" should read -- too significant a --;
Line 13, "depend" should read -- depending --;
Line 16, "sizes" should read -- sizes. --; and "a" should read -- an --;
Line 36, "is consisted" should read -- consists --;
Lines 57, 63 and 67, "by" should read -- in --; and
Line 58, "to" should be deleted.

Column 5,
Lines 5, 11, 15, 20 and 25, "by" should read -- in --;
Line 17, "connected" should read -- connected to --; and
Line 38, "A" should be deleted.

UNITED STATES PATENT AND TRADEMARK OFFICE

CERTIFICATE OF CORRECTION

PATENT NO. : 6,419,349 B1
DATED : July 16, 2002
INVENTOR(S) : Shuzo Iwanaga et al.

It is certified that error appears in the above-identified patent and that said Letters Patent is hereby corrected as shown below:

Column 7,
Lines 1 and 12, "referred" should read -- referred to --;
Line 33, "is consisted" should read -- consists --;
Line 47, "M1001. Which enable" should read -- M1001, which enables --; and
Line 60, "a" (first occurrence) should read -- an --.

Column 8,
Line 15, "is" should read -- are --; and
Line 40, "so called a" should read -- a so called --.

Column 9,
Line 21, "dusts" should read -- dust --; and
Line 53, "referred" should read -- referred to --.

Column 10,
Line 5, "in stead" should read -- instead --;
Line 16, "a" should read -- an --;
Line 23, "aide" should read -- aid --; and
Line 29, "in-the" should read -- in the --.

Column 11,
Line 32, "LFIPG" should read -- LF/PG --;
Line 50, "a" should be deleted; and
Line 62, "smoothed the power" should read -- the power is adjusted --.

Column 12,
Line 37, "almost all portion" should read -- to almost all portions --.

Column 13,
Line 13, "(a 1284" should read -- (1284 --;
Line 35, "an" should read -- a --; and
Line 42, "transfer" should read -- transfers --.

Column 14,
Line 26, "Base" should read -- Based --;
Line 30, "CPUIIF" should read -- CPUI/F --;
Line 55, "is" should read -- are --; and
Line 58, "start" should read -- starts --.

UNITED STATES PATENT AND TRADEMARK OFFICE

CERTIFICATE OF CORRECTION

PATENT NO. : 6,419,349 B1
DATED : July 16, 2002
INVENTOR(S) : Shuzo Iwanaga et al.

It is certified that error appears in the above-identified patent and that said Letters Patent is hereby corrected as shown below:

Column 15,
Line 27, "followed" should read -- following --; and
Line 29, "sent" should read -- send --.

Column 16,
Line 5, "connected" should read -- connected to --; and
Line 67, "is" should read -- are --.

Column 18,
Line 5, "a" should read -- an --; and
Line 48, "transporting" should read -- transporting of --.

Column 19,
Line 11, "comprised" should read -- comprised of --;
Line 12, "are" should read -- is --;
Line 13, "H1905a" should read -- H1905a, which --;
Line 23, "a" should be deleted;
Line 27, "present" should read -- the present --.

Column 20,
Line 55, "4," should read -- 5, --.

Signed and Sealed this

Twenty-third Day of December, 2003

JAMES E. ROGAN
*Director of the United States Patent and Trademark Office*